US012108840B2

(12) United States Patent
Busch

(10) Patent No.: US 12,108,840 B2
(45) Date of Patent: Oct. 8, 2024

(54) UPPER FOOT CARRIED FOOTWEAR COMFORT-ENHANCING FITMENT

(71) Applicant: Joan Charles Van Den Busch, Arkdale, WI (US)

(72) Inventor: Joan Charles Van Den Busch, Arkdale, WI (US)

( * ) Notice: Subject to any disclaimer, the term of this patent is extended or adjusted under 35 U.S.C. 154(b) by 0 days.

(21) Appl. No.: 16/529,925

(22) Filed: Aug. 2, 2019

(65) Prior Publication Data

US 2020/0037701 A1 Feb. 6, 2020

Related U.S. Application Data

(60) Provisional application No. 62/714,000, filed on Aug. 2, 2018.

(51) Int. Cl.

| | |
|---|---|
| ***A43B 7/14*** | (2022.01) |
| ***A43B 7/149*** | (2022.01) |
| ***A43B 23/26*** | (2006.01) |

(52) U.S. Cl.

CPC ..... *A43B 7/149* (2013.01); *A43B 7/14* (2013.01); *A43B 23/26* (2013.01)

(58) Field of Classification Search

CPC ..... A43B 7/14; A43B 7/1405; A43B 7/149; A43B 23/07; A43B 23/26

USPC ..... 36/71

See application file for complete search history.

(56) References Cited

U.S. PATENT DOCUMENTS

| | | | | | |
|---|---|---|---|---|---|
| 147,698 | A | * | 2/1874 | Smith | A43B 5/0407 36/71 |
| 326,728 | A | * | 9/1885 | Georges | A43B 5/12 36/71 |
| 374,106 | A | * | 11/1887 | Winter | A43B 5/0407 36/71 |
| 1,215,198 | A | * | 2/1917 | Rothstein | A43B 23/26 36/54 |
| 1,741,340 | A | | 12/1929 | Scholl | |
| 1,886,134 | A | * | 11/1932 | Sunderland | A43B 7/1465 36/72 R |
| 1,954,122 | A | * | 4/1934 | Fiori | A43B 3/02 36/71 |
| 2,090,573 | A | * | 8/1937 | Alessandro | A43B 23/0235 36/71 |

(Continued)

FOREIGN PATENT DOCUMENTS

GB 2460019 4/2010

*Primary Examiner* — Marie D Bays

(74) *Attorney, Agent, or Firm* — Boyle Fredrickson S.C.

(57) ABSTRACT

A flexible shoe snugging fitment is oblong with a thickness providing pad that is carried on top of a foot, preferably held in place against the foot with hosiery, which underlies and spaces a top part, e.g., vamp, of an article of footwear, e.g., shoe or boot, from the foot snugging the footwear on the foot improving fit and helping prevent relative movement therebetween. A preferred fitment is oblong and transversely oriented relative to a lengthwise fore-aft extent of the foot. Fitment has a central portion from which flaps extend oppositely outwardly that each extend around part of a corresponding side of the foot helping to prevent side-to-side relative movement between the foot and footwear worn on the foot. One preferred fitment is an assembly with a smaller adjuster pad slidably received in a pocket in a pad carrier with the pad extendable to adjust thickness and width of the assembly.

32 Claims, 32 Drawing Sheets

(56) References Cited

U.S. PATENT DOCUMENTS 2,697,886 A * 12/1954 Spinali ..... A43B 3/02 36/71
3,372,495 A * 3/1968 Finn ..... A43B 5/0407 36/117.6
3,531,878 A * 10/1970 Corry ..... A43B 7/32 36/109
3,667,140 A * 6/1972 Hunderford ..... A43B 7/32 36/71
3,693,270 A * 9/1972 Murray ..... A43B 19/00 36/58.5
4,534,122 A 8/1985 Macphail
4,583,303 A 4/1986 Laiacona et al.
5,007,111 A 4/1991 Adams
5,131,174 A 7/1992 Drew et al.
5,265,353 A * 11/1993 Marega ..... A43D 999/00 36/117.6
5,526,584 A 6/1996 Bleimhofer et al.
5,746,015 A * 5/1998 Clement ..... A43B 5/0405 36/10
5,823,195 A 10/1998 Shook et al.
6,196,986 B1 3/2001 Gardiner
6,490,730 B1 * 12/2002 Lyden ..... A41D 13/0153 2/22
6,543,058 B2 * 4/2003 Litke ..... A63B 71/143 2/159
6,558,339 B1 5/2003 Graham
6,584,707 B1 * 7/2003 Racine ..... A43B 3/26 36/112
6,618,962 B1 * 9/2003 Covatch ..... A43B 7/32 36/71
6,681,403 B2 * 1/2004 Lyden ..... A41D 13/0153 2/22
6,810,603 B1 11/2004 Cosentino
6,918,140 B1 * 7/2005 Cooper ..... A41D 1/084 2/228
7,018,351 B1 3/2006 Iglesias et al.
7,022,096 B1 4/2006 Alfieri
7,219,531 B2 * 5/2007 Hammons ..... A41D 19/01523 73/12.13
7,314,840 B2 * 1/2008 Baychar ..... A43B 5/0405 36/117.3
7,669,251 B2 * 3/2010 Hammons ..... A43B 13/189 2/161.1
8,181,362 B2 5/2012 Davis
8,205,271 B2 * 6/2012 Canci ..... A41B 11/02 2/239
8,490,300 B1 * 7/2013 Houston, III ..... A43B 23/0265 36/77 R
8,585,623 B2 * 11/2013 Ingimundarson ..... A61F 5/0102 602/5
9,839,259 B2 12/2017 Arquilla
2001/0032398 A1 * 10/2001 Maritz ..... A43B 7/32 36/72 R
2002/0083622 A1 * 7/2002 Joubert ..... A43B 7/1495 36/117.6
2003/0082970 A1 * 5/2003 Moberg-Alehammar ..... A61Q 19/00 442/123
2005/0034329 A1 * 2/2005 Chen ..... A43B 23/07 36/45
2006/0090371 A1 5/2006 Chan
2007/0209237 A1 * 9/2007 Denha ..... A43B 23/086 36/71
2007/0234595 A1 * 10/2007 Davis ..... A43B 3/26 36/94
2007/0283598 A1 12/2007 Gray
2008/0060222 A1 * 3/2008 Cagliari ..... A43B 5/0405 12/146 R
2008/0209616 A1 * 9/2008 Manning ..... A41B 11/02 2/240
2009/0106879 A1 4/2009 Post
2009/0205097 A1 * 8/2009 Manning, II ..... A41B 11/02 2/22
2011/0000103 A1 * 1/2011 Hahn ..... A43B 1/0027 36/71
2011/0078921 A1 * 4/2011 Greene ..... A43B 23/025 36/47
2012/0167418 A1 * 7/2012 Frappier ..... A43B 23/26 36/115
2012/0167899 A1 * 7/2012 Dorsey ..... A43B 17/003 128/894
2014/0317955 A1 * 10/2014 Levine ..... A43B 7/1435 36/28
2015/0059205 A1 * 3/2015 McCulloch ..... A43B 23/26 36/45
2015/0306839 A1 * 10/2015 Beliveau ..... A41D 31/065 428/195.1
2020/0128917 A1 * 4/2020 Felso ..... A43B 23/26
2020/0214397 A1 * 7/2020 Conti ..... A43B 7/32

* cited by examiner

UPPER FOOT CARRIED FOOTWEAR COMFORT-ENHANCING FITMENT

CROSS REFERENCE

This application claims priority to U.S. Provisional Patent Application Ser. No. 62/714,000 titled "Adjustable Comfort-Enhancing Footwear Fitment" filed on Aug. 2, 2018, the entire disclosure of which is expressly incorporated herein.

FIELD

The present invention is directed to a footwear fitment and more particularly to a footwear fitment that is an upper-foot carried orthotic that improves foot comfort by helping position footwear worn on a foot carrying the fitment and/or helping snug footwear around a foot wearing the fitment.

BACKGROUND

The human foot is a relatively complicated part of the human body that we use every day when we stand, walk, work, dance, jog, and run using our feet. The foot is elongate and formed of three distinct regions including a hindfoot or rear foot region at the rear of the foot, which includes the heel formed of the calcaneus or heel bone and a posterior part of the ankle that includes the talus or ankle bone, a forefoot or front foot region at the front of the foot, which includes the toes, metatarsal bones and ball of the foot, and a midfoot or middle foot region forming the middle of the foot extending between the hindfoot and forefoot, which includes an arch and instep along the underside of the foot and a bridge along the top of the foot together with tarsal bones that form an anterior part of the ankle or anterior ankle. The foot has a dorsal side extending along the top of the foot that also can be referred to as the dorsum (the surface of the midfoot and forefoot that faces upwardly while standing), a plantar side extending along the sole or bottom of the foot that also can be referred to as the planum (the surface of the foot that faces downwardly while standing), a distal side along the front of the foot where the toes are located, a proximal side along the rear of the foot where the heel is located, a medial side along an inboard side of the foot along where the arch of the foot is located, and a lateral side along an outboard side of the foot. The foot is connected to the bones of the leg, namely the tibia and fibula, by the ankle with the anterior ankle being part of the midfoot region of the foot that extends from the anterior ankle forwardly or distally to the Lisfranc joint where the tarsal and metatarsal bones connect.

Many specialized types of footwear, mostly specialized types of shoes and boots, have been developed over the years that are designed to protect our feet, improve performance for the type of activity for which they are intended to be worn, absorb and reduce foot impact forces transmitted to other parts of the body, encourage proper posture, and increase safety all while typically being aesthetically pleasing. Examples of different types of shoes include dress shoes, such as oxfords and bluchers, heeled shows, such as high heeled boots or high heeled shoes like stilettos and slingbacks, for women, sneakers, loafers, tennis shoes, track shoes, baseball and football cleats, boat shoes, steel-toed shoes, and other types of shoes which substantially enclose each foot of a person wearing them. Examples of different types of boots include hiking boots, military or combat boots, logger boots, cowboy boots, steel-toed boots, high heeled boots, chukkas and Chelsea boots which substantially enclose each foot and typically a lower portion of the leg of a person wearing them.

Shoe and boot footwear are typically designed to substantially enclose or encapsulate the foot of the person wearing them. They are commonly composed of an elongate sole that underlies and supports the corresponding elongate fore-aft or medial-distal extending lengthwise extent of a sole or bottom of a foot and an upper extending upwardly from the sole which forms an enclosure or housing that wraps around the rest of the foot typically covering substantially the entire hindfoot, midfoot and hindfoot regions of the foot. The sole of the shoe or boot typically includes an insole upon which the sole of the foots rests, an outsole contacting the ground or floor during use and which can include a heel at the rear that underlies a heel of the foot, and which can further include a midsole between the insole and outsole. The shoe or boot upper includes a counter along the rear that wraps around and can cup the heel of the foot, side panels or quarters that extend along opposite sides of the foot, a vamp that extends along the dorsum, dorsal, top or upper portion of the foot with the vamp typically including a toe-box or toe-puff enclosing the toes and which also can have an elongate tongue extending between the quarters or side panels outwardly toward an ankle of the foot. Where the footwear is a boot, the tongue of the vamp can also extend upwardly to and along part of the leg.

The relatively complex structure of the foot along with variations in size, shape and structure common amongst the population combined with differences in footwear construction, design, material performance and durability characteristics, wear patterns, stability, support and the like make choosing footwear that not only fits properly when purchased but which retains adequate fit after break-in and during prolonged usage remains an incredibly difficult challenge. While fitting problems are common with people who have narrower Fitting problems are well known with people who have narrower or wider than average feet. However, it is not uncommon for footwear that appears properly fitted at purchase to lose proper fit due to stretching, sole compaction or wear over time for everyone, not just those with narrow or wide feet.

In the past, numerous different types of devices have been tried with mixed success to improve foot comfort, relieve foot and joint pain, provide arthritis relief, help promote injury healing, facilitate injury rehabilitation, prevent overuse, provide orthopedic correction, reduce odor, or improve athletic performance. In almost all instances, these devices are in the form of foot orthotics or foot orthosis that are configured for in-shoe placement, typically in the form of a shoe insert, e.g., shoe orthotic insert, which is inserted into the shoe so it overlies the shoe insole and underlies the foot of a person wearing the shoe in which the insert has been placed.

Unfortunately, choosing from myriad types of available shoe inserts is often a trial and error process that is as challenging as it is confusing such that it is not uncommon for a person to purchase several, sometime several dozen, different types, constructions and shapes of shoe inserts until they find one that helps. While shoe sizes are supposed to be uniform, there often are slight but significant variations in width, length, contour, fit, and the like amongst shoes of a given size sometimes making it very difficult to find a shoe that fits, let alone an insert that fits. Even if the insert fits, these shoe size variations can slightly offset the proper location of the insert in the shoe relative to a foot received in the shoe thereby reducing or even negating the effectiveness of the insert. Even when a shoe insert helps, it often does not completely solve all of the problems that led them to shoe inserts in the first place.

This is especially true of many types of women's shoes, particularly high-heeled boots. Many women report foot, knee, hip, and lower back pain while wearing high heeled boots. Such pain tends to be caused by increased pressure on the toes and ball of the foot due to the foot sliding forward in high-heeled shoes, the increased amount of time the ball of the foot is on the ground during each step, the increased pressure high heeled shoes cause to be put on the medial or big toe side of the foot, the use of a flattened heel pad in high-heeled shoes, the significantly increased strain placed on the Achilles tendon during each step wearing high-heeled shoes which tends to want to shorten Achilles tendon length, the failure to properly extend the knee through its full range of motion, during each step, e.g., lack of terminal knee extension with gait, and the adverse impact high-heeled shoes can have upon lower back curvature, e.g., increased lumbar lordosis, over time. Prior attempts have been made to add cushioning or change the shape of high-heeled shoes to decrease the pain and other such maladies associated with high-heeled shoe use have met with limited success. While there also have been many prior attempts at designing shoe inserts for high-heeled shoes, such designs not only possess limited effectiveness, they are also very difficult to make that fit all types of high-heeled shoes for a given size.

While wearers of boots and other types of shoes have fewer problems than high-heeled shoe wearers, problems nonetheless persist. While many of the myriad shoe insert orthotic devices out on the market do provide some relief, quite often they too do not address all of the problems suffered by the wearer. This is because virtually all of these shoe inserts do nothing to correct fore-aft foot location misalignment that typically occurs with improperly fitting shoes and boots. And virtually all of these shoe inserts do nothing to compensate for problems with shoes and boots that fit poorly because they are too large or have become too large for the foot of the wearer with extended use.

What is needed is an orthotic device that overcomes one or more of the above-shortcomings of existing in-shoe placed orthotics. What is needed is an orthotic device suitable for use with heeled shoe wearers, particularly high-heeled shoe wearers, to alleviate at least some of myriad problems typically experienced by them. What also is needed is an orthotic device that helps properly align the shoe on the foot and/or the foot in the shoe. What is still further needed is an orthotic device that compensates for shoes and boots that have too large of a fit or become too large over time due to stretching, wear and the like as typically occurs the longer the shoe or boot is worn by a user. What also is needed is a device that addresses one or more of the above-shortcomings of in-shoe placed foot orthotics like shoe inserts whose use and operation is not limited by subjective personal preferences and differences in shoe variations for a given shoe size.

SUMMARY

The present invention is directed to a foot-carried shoe orthotic in the form of a footwear comfort improving fitment that is carried or worn on a top portion of a foot received in an article of footwear, such as a shoe or boot, disposing the fitment between the top portion of the foot and a top portion of an upper or vamp of the footwear for snugging up the footwear around the foot thereby improving comfort by improving fit of the footwear on the foot. The fitment includes at least a plurality of pairs, i.e., at least three, layers that include a pair of outer layers and at least one inner layer between the outer layers that is a pad that provides a spacer giving thickness or volume to the fitment to provide footwear snugging when worn on top of a foot inserted into the footwear. In a preferred embodiment, the fitment is retained against the skin of the top portion of the foot, preferably a midfoot region adjacent the ankle, by hosiery, such as a sock, worn over the foot before placement into the footwear with the hosiery maintaining proper location of the fitment relative to the top portion of the upper or vamp of the footwear worn by the foot.

In one preferred embodiment, the outer layers of the fitment are constructed of cloth or fabric and the one or more inner layers are composed of two or more layers of wool, cotton, or a synthetic material that can be of woven or nonwoven construction. In a second preferred embodiment, a first outer layer of the fitment covers a first surface of the fitment intended to face and be in contact with skin of the top of the foot of a person wearing the fitment with the first outer layer being composed of a material possessing increased friction that engages with the skin on the top of the foot to prevent the fitment from sliding relative to the foot during footwear snugging use. In the second preferred embodiment, a second outer layer is composed of a lower friction slippery material that is covered by hosiery, e.g., sock, covering the foot thereby preventing the fitment from being moved by the hosiery relative to the foot against which the fitment is disposed. In the second embodiment, the at least one inner layer is composed of a foam layer, such as a foam layer made of a urethane foam, which can be an open cell foam, but which preferably is a closed cell foam.

The fitment preferably is oblong, flexible and transversely oriented relative to a lengthwise fore-aft extent of the foot when placed on top of the foot during positioning the fitment on the foot in wearing the fitment on the foot. The fitment is flexible for being conformable to a three-dimensional contour of the top of the foot and preferably also to be conformable to the part of the upper or vamp of the footwear worn on the foot covering or overlying the fitment. The oblong fitment has a central base with a thickness provided by the pad that functions as a spacer which helps snug the footwear on the foot in a fore-aft or proximal-distal direction preferably thereby also preventing fore-aft or proximal-distal movement (i) of the foot within the footwear relative to the footwear, and/or (ii) of the footwear worn on the foot relative to the foot. The oblong fitment has a pair of wings extending oppositely outwardly from the central base that also have a thickness, preferably also provided by the pad, which correspondingly extend transversely along a portion of opposite sides of the foot at, along or adjacent the ankle that help snug the footwear on the foot in a side-to-side or medial-lateral direction preferably thereby also preventing side-to-side or medial-lateral movement (i) of the foot within the footwear relative to the footwear, and/or (ii) of the footwear worn on the foot relative to the foot.

Another preferred embodiment of a fitment constructed in accordance with the present invention is a width and thickness adjustable fitment assembly that has a fitment pad carrier that is oblong in shape and transversely oriented across the top of the foot upon which it is worn with the fitment pad carrier having a pocket formed therein for releasably receiving and retaining a slidable thickness-increasing fitment adjuster pad in the pocket. The fitment adjuster pad can be slide into or out of the pocket in trombone fashion to vary the width and thickness of the adjustable fitment assembly to vary the amount of snugness desired.

The fitment pad carrier is of the same or like construction as one of the preferred fitments described hereinabove having a flexible, compressible and resilient foam or fabric thickness-providing pad within that serves as a spacer to space an overlying portion of the upper or vamp of the footwear away from an underlying portion of the midfoot or ankle region of the foot during fitment use and operation. The fitment adjuster pad also is of the same or like construction as one of the preferred fitments described hereinabove that also has a flexible, compressible and resilient foam or fabric thickness-providing pad within.

During fitment adjustment, the fitment adjuster pad can be fully inserted into the pocket in the fitment pad carrier such that no part of the fitment adjuster pad extends outwardly beyond the periphery of the fitment pad carrier thereby providing increased thickness, preferably imparting two times or double the thickness, to the central base of the fitment assembly. The fitment adjuster pad can be slidably extended from the pocket causing part of the fitment adjuster pad to extend outwardly beyond the periphery of the fitment pad carrier thereby increasing the surface area of the adjustment fitment in a fore-aft or proximal-distal direction preferably also helping to further snug the footwear up with the foot in a fore-aft or proximal-distal direction. When the fitment adjuster pad is disposed in such a partly extended adjustment position, the thickness of the adjustable fitment assembly is greater than the thickness of the fitment pad carrier alone and the width of the adjustable fitment assembly is greater than the width of the fitment pad carrier alone. The fitment adjuster pad can be further extended until only a portion of the fitment adjuster pad is retained or received in the pocket such that when fully extended the thickness is about the same as the thickness of the fitment pad carrier and the width is between one and one-half and two times the width of the fitment pad carrier.

Other advantages, benefits and features of the present invention will become apparent to those skilled in the art upon reading the detailed description and viewing the related drawings.

DRAWING DESCRIPTION

One or more preferred exemplary embodiments of the invention are illustrated in the accompanying drawings in which like reference numerals represent like parts throughout and in which.

Figure 8:
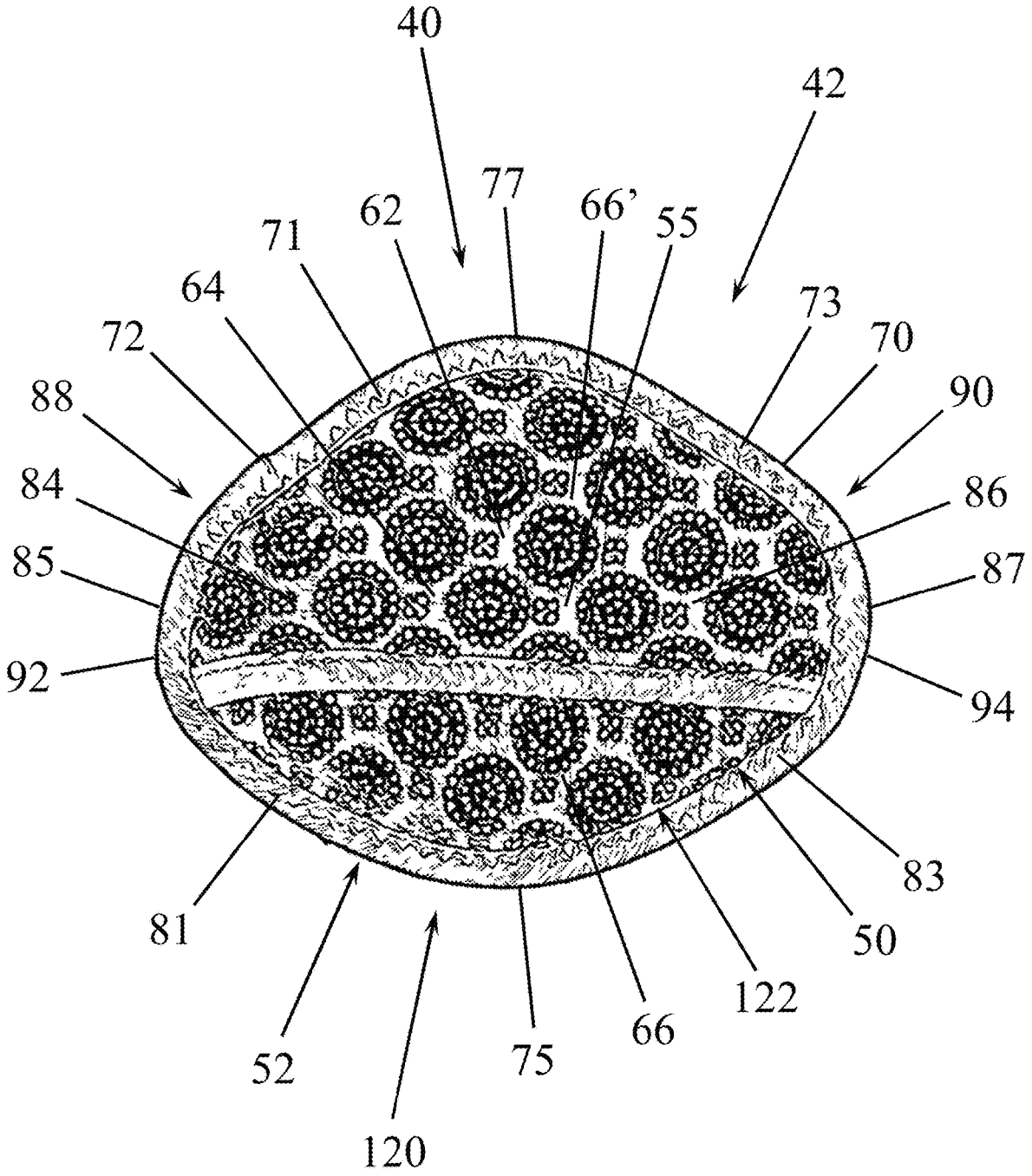
FIG. 8 is a top plan view a third preferred embodiment that is an adjustable footwear fitment assembly of the present invention that is of two-piece construction and which provides thickness and fitment surface area adjustability.
Figure 9:
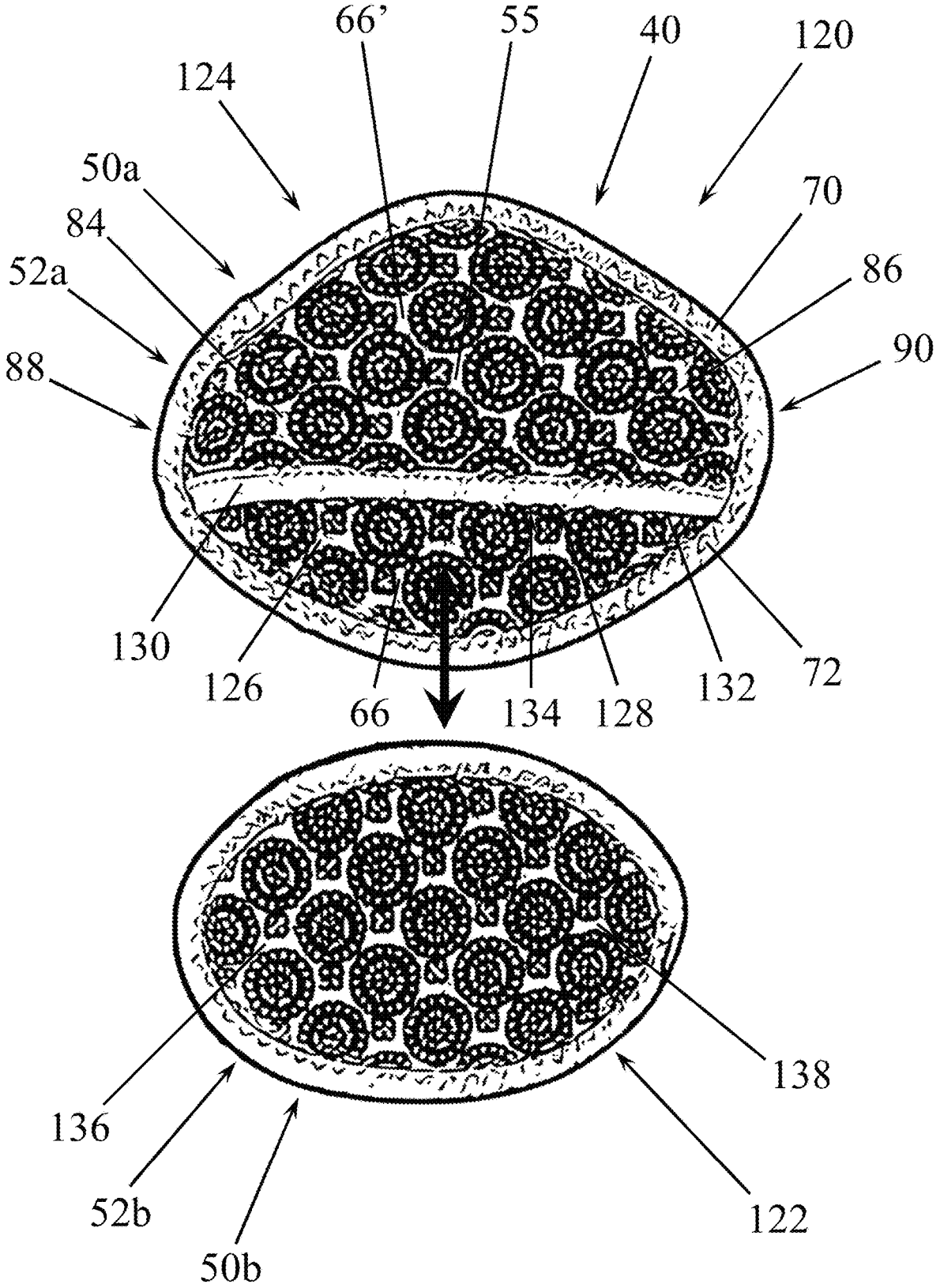
FIG. 9 is a top plan exploded view of the adjustable fitment assembly of FIG. 8 depicting a fitment pad carrier with a pocket formed therein configured for slidably and adjustably receiving a smaller fitment adjuster pad used to at least one of increase thickness and surface area of the adjustable fitment assembly.
Figure 10:
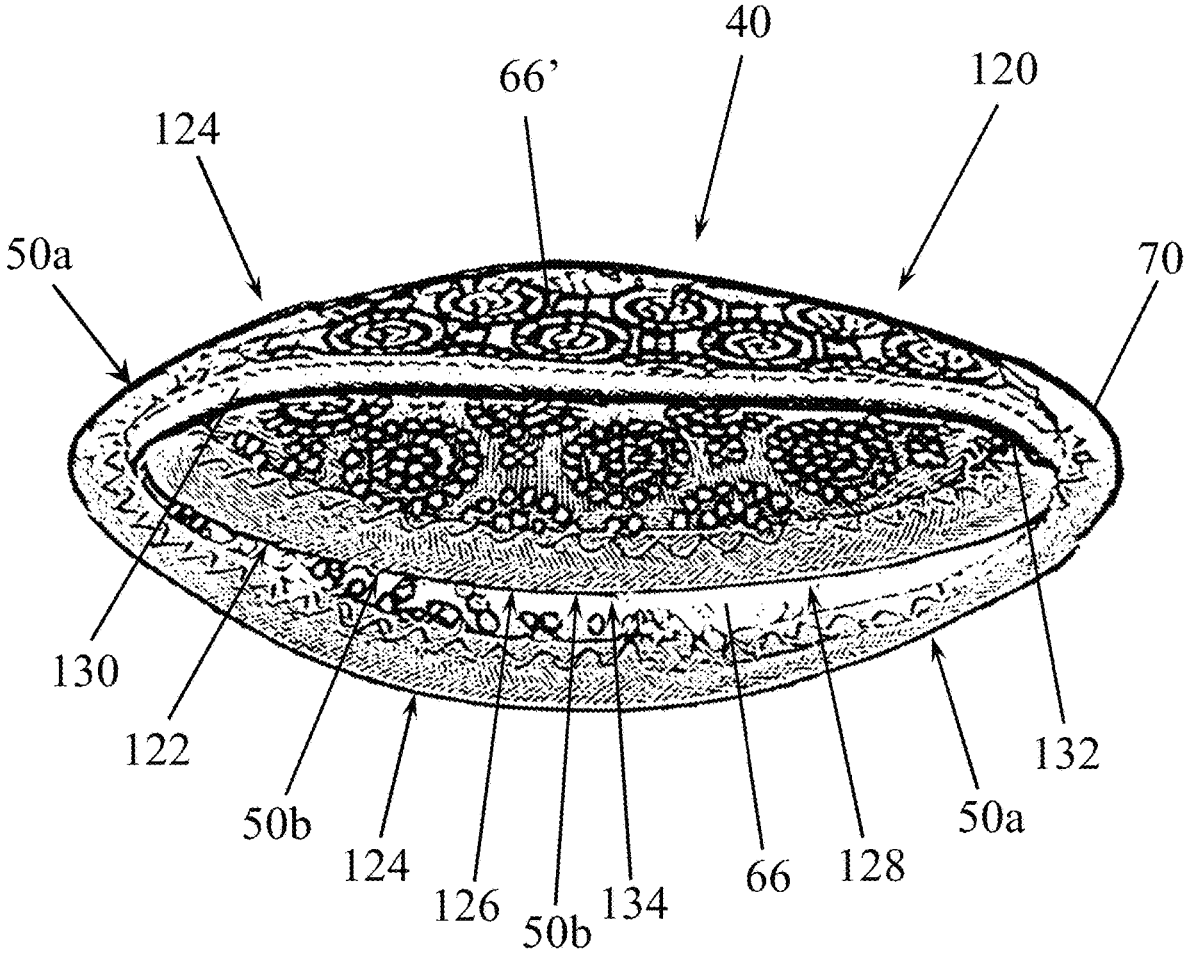
FIG. 10 is a side perspective view of the adjustable fitment assembly of FIGS. 8 & 9 depicting the increased thickness of the fitment assembly when the fitment adjuster pad is fully inserted or completely retracted into the pocket of the fitment pad carrier.
Figure 11:
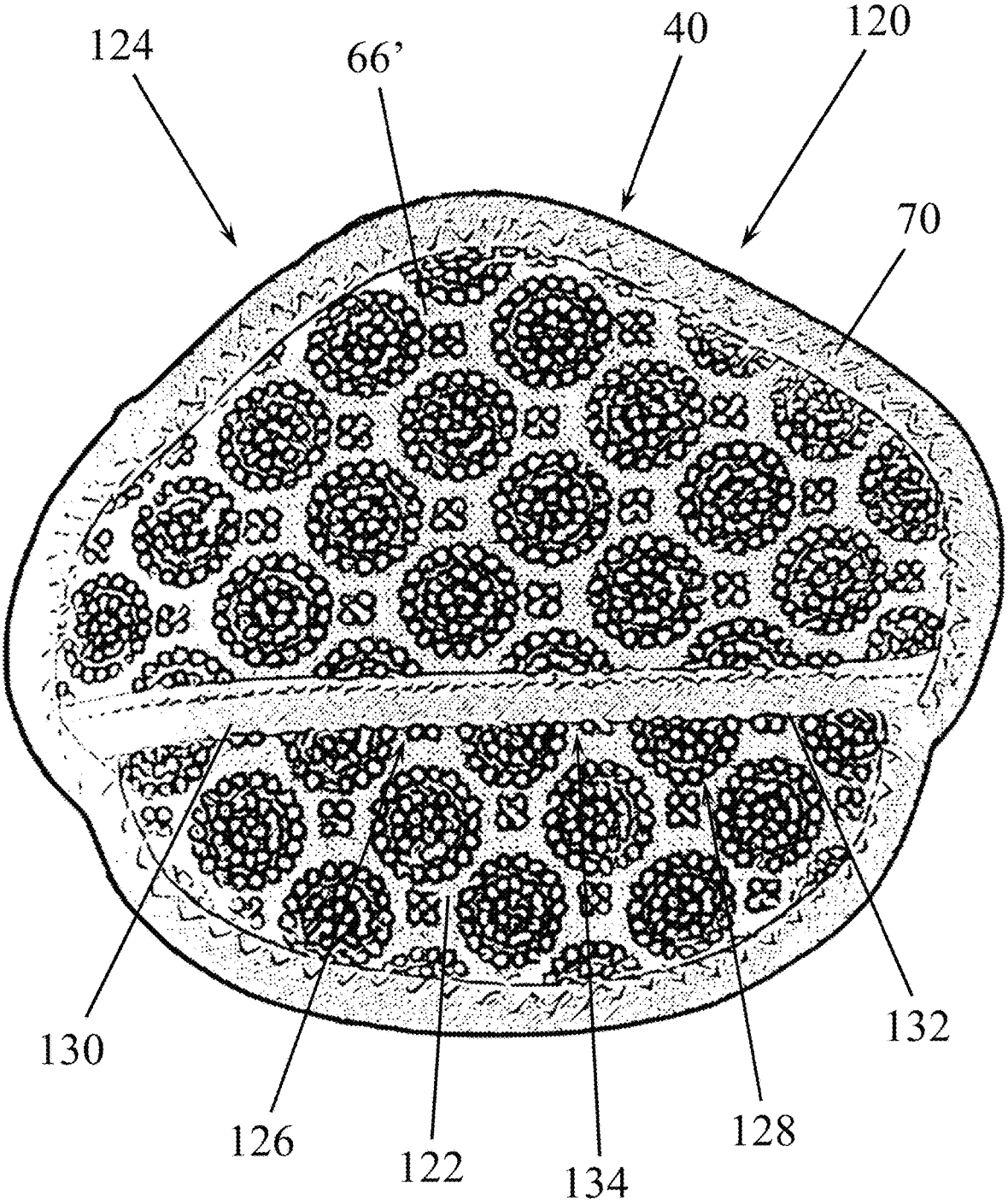
Figure 12:
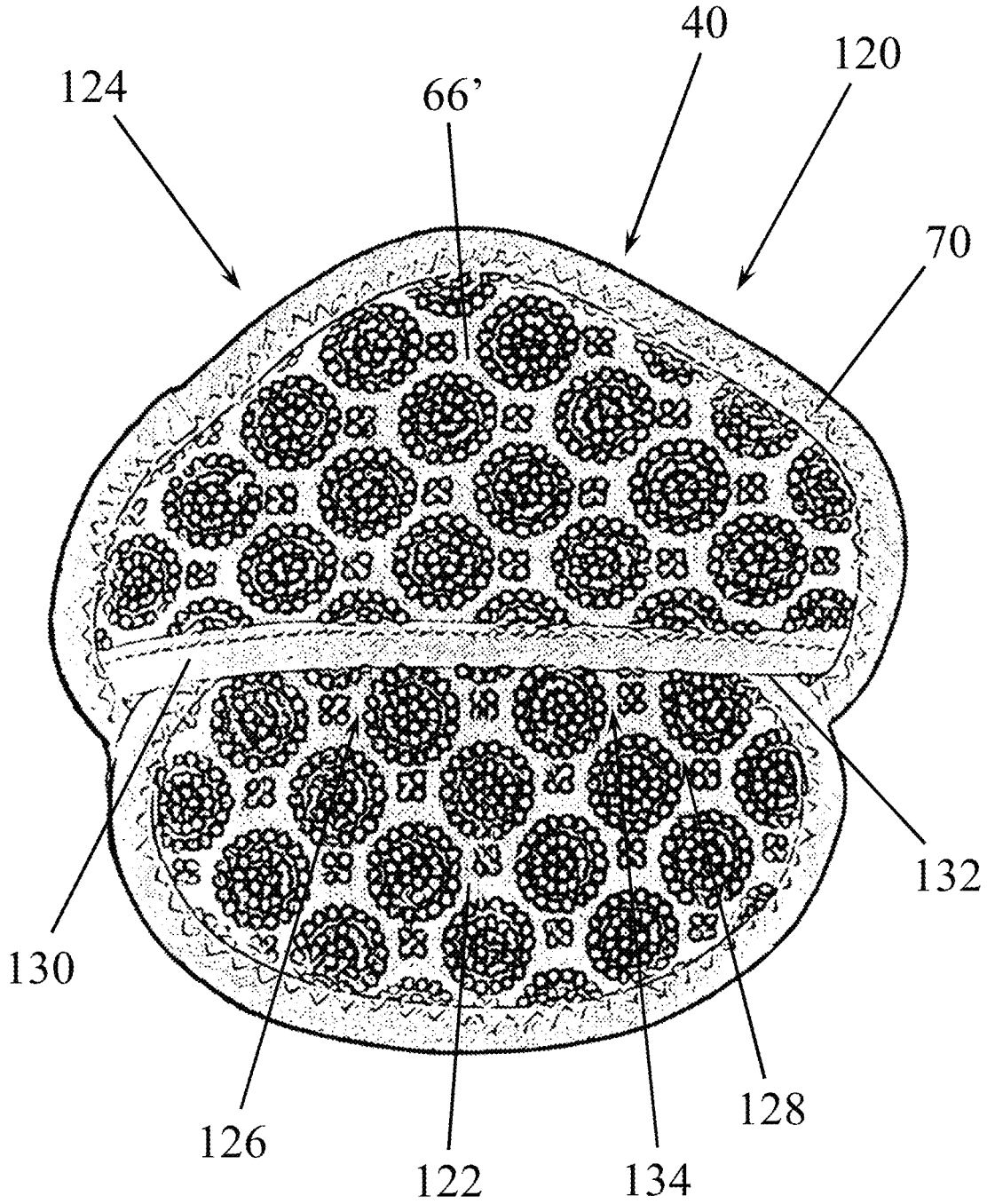
Figure 13A:
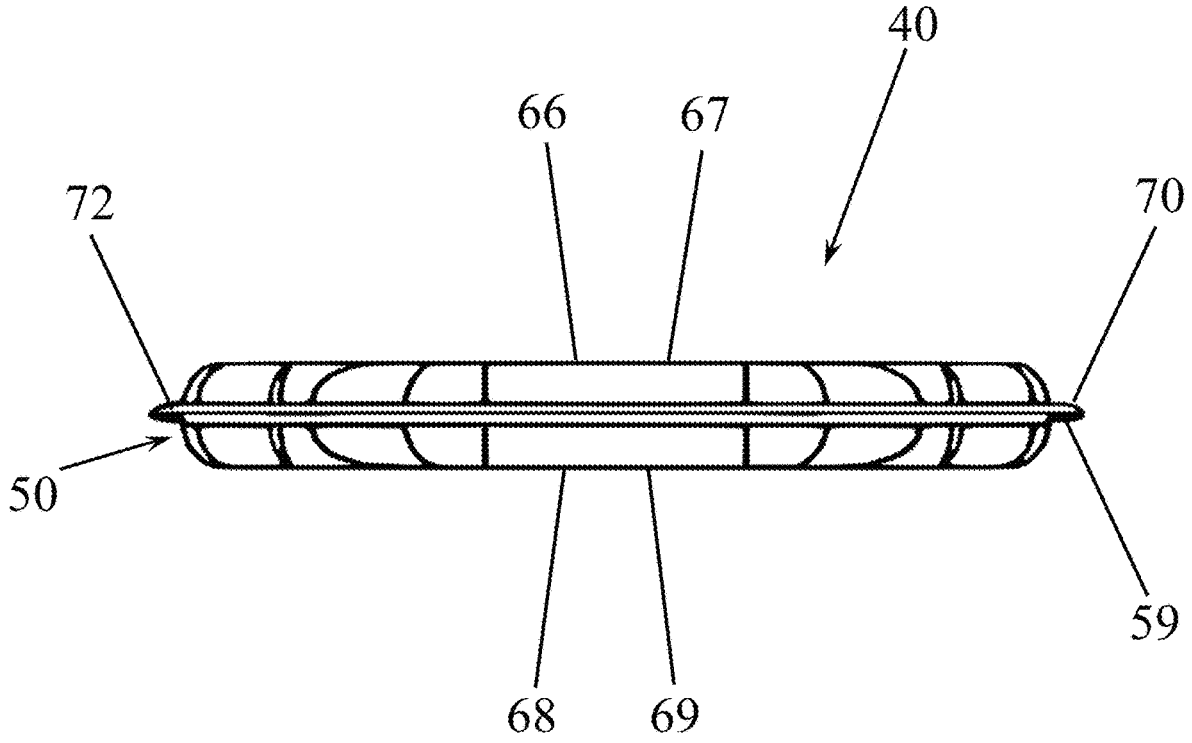
Figure 13B:
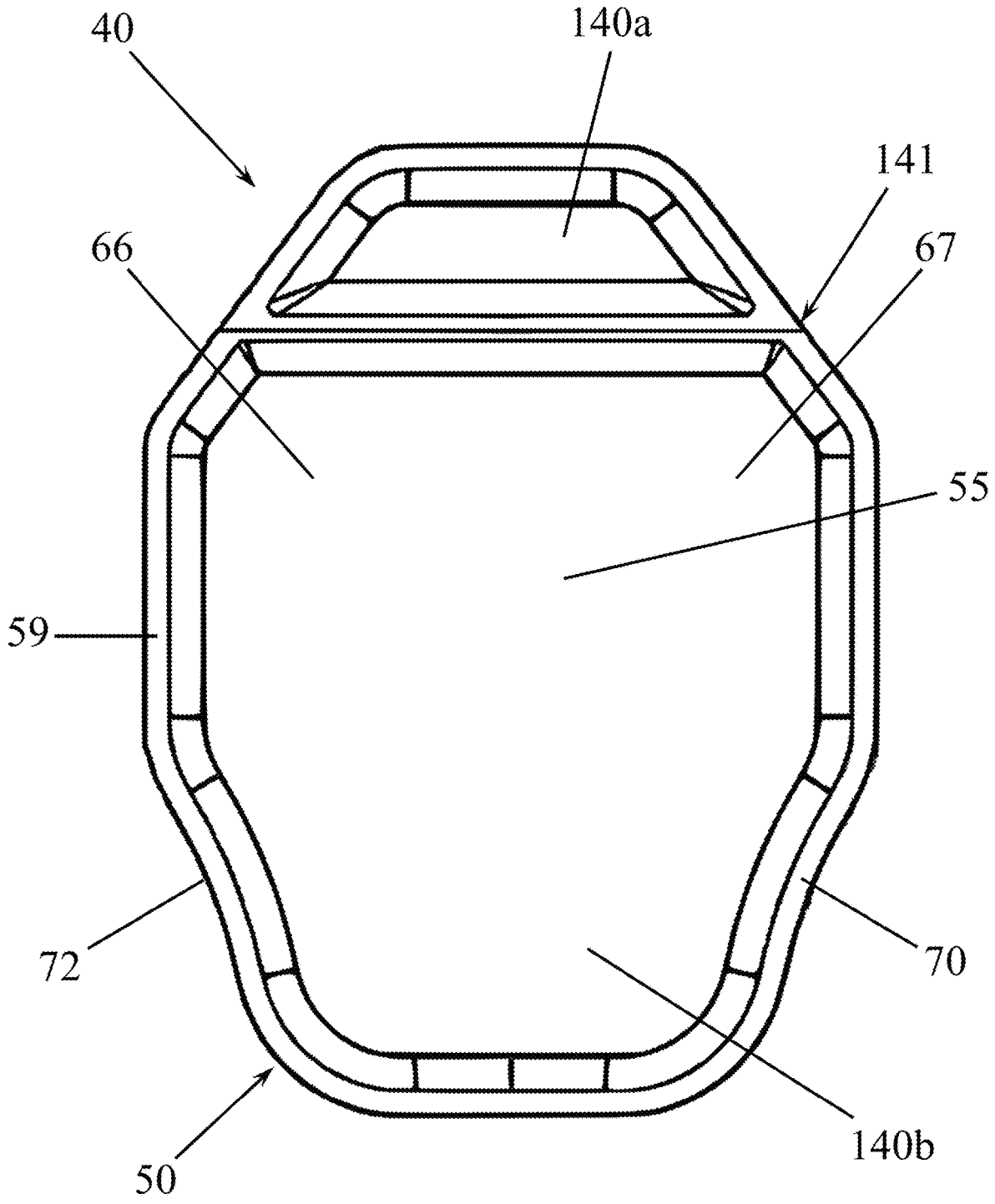
Figure 13C:
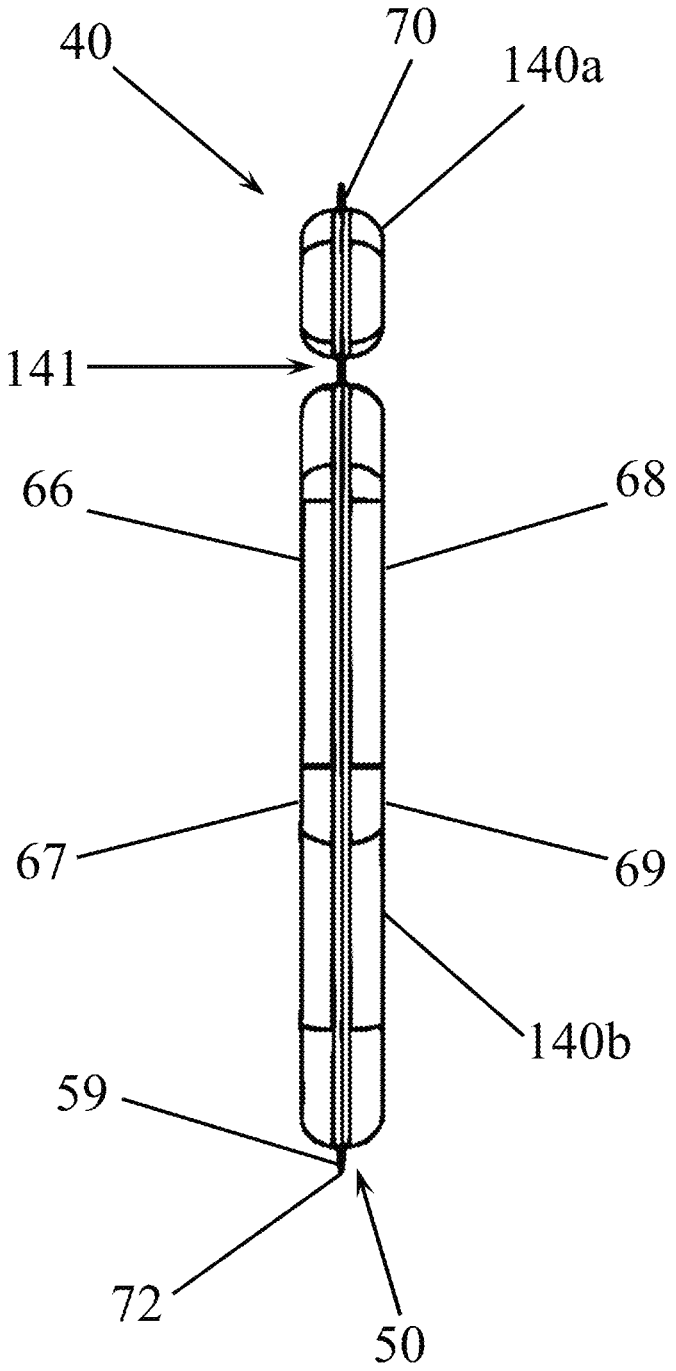
Figure 13D:
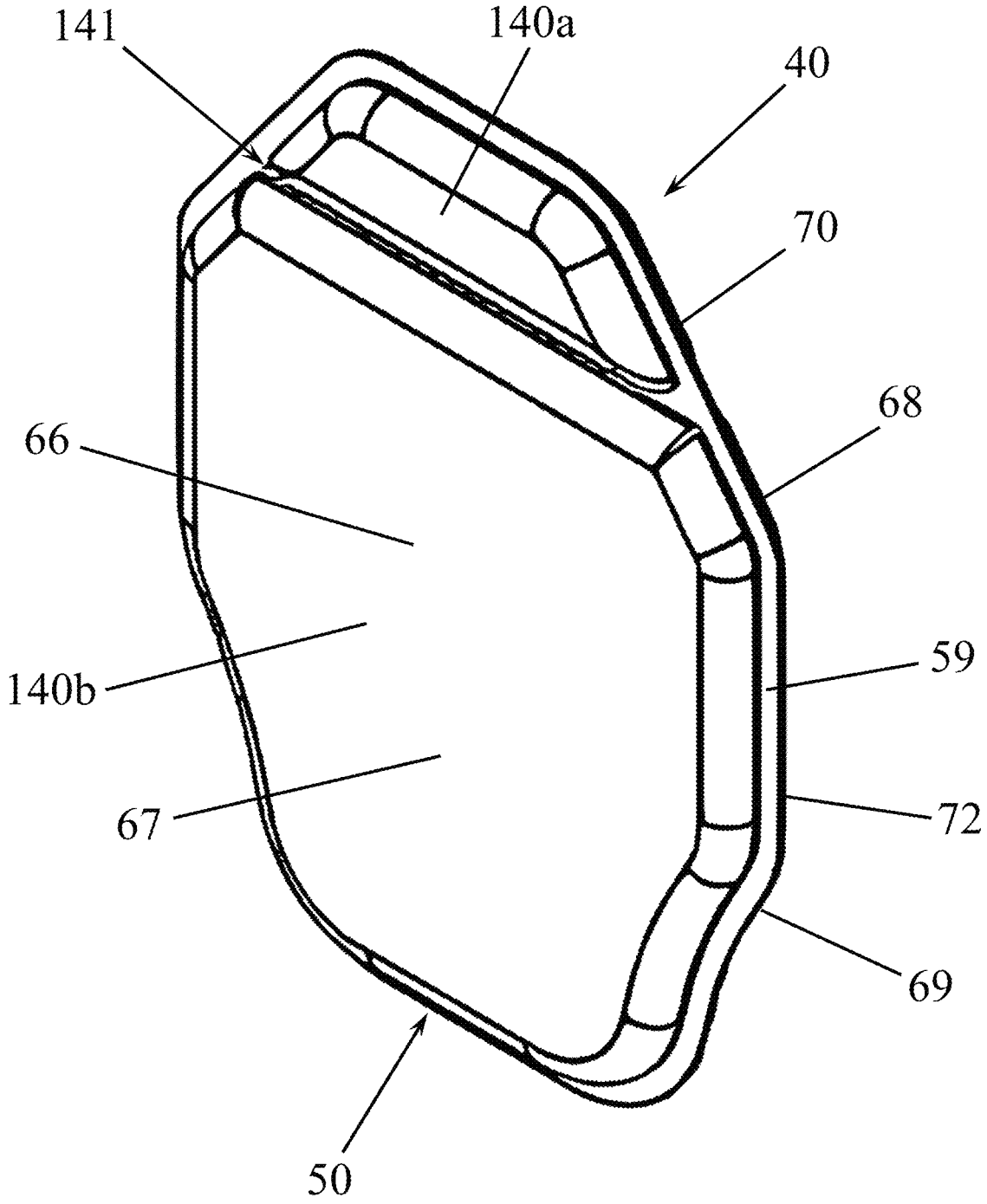
Figure 14A:
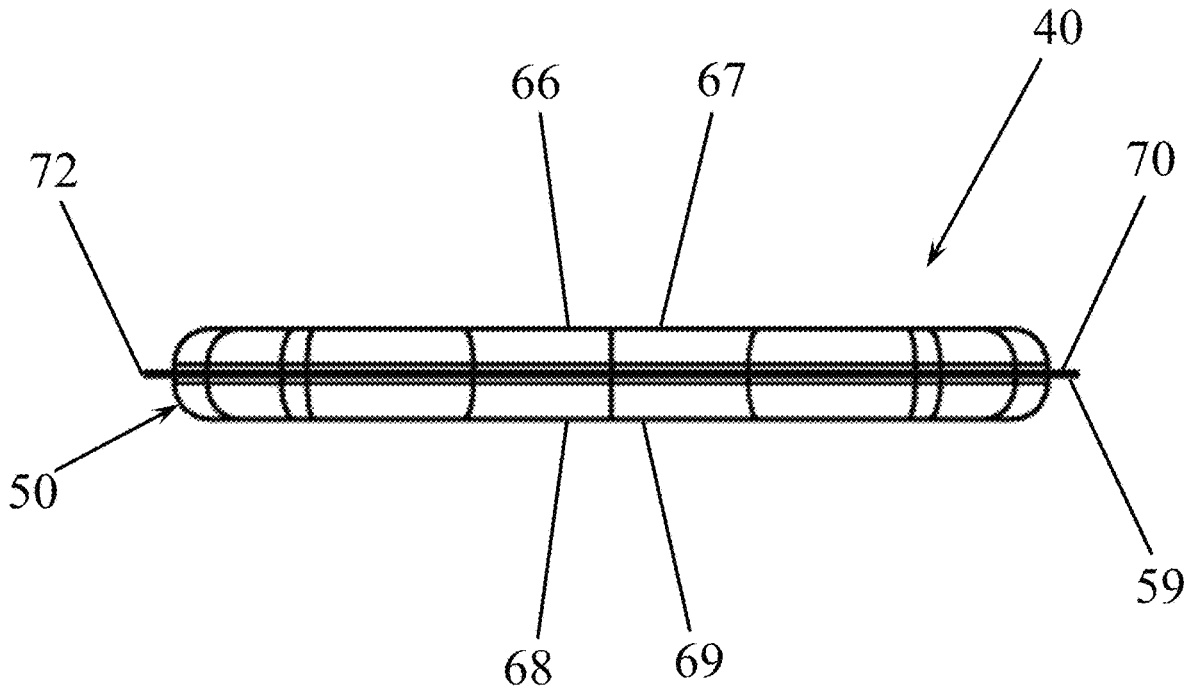
Figure 14B:
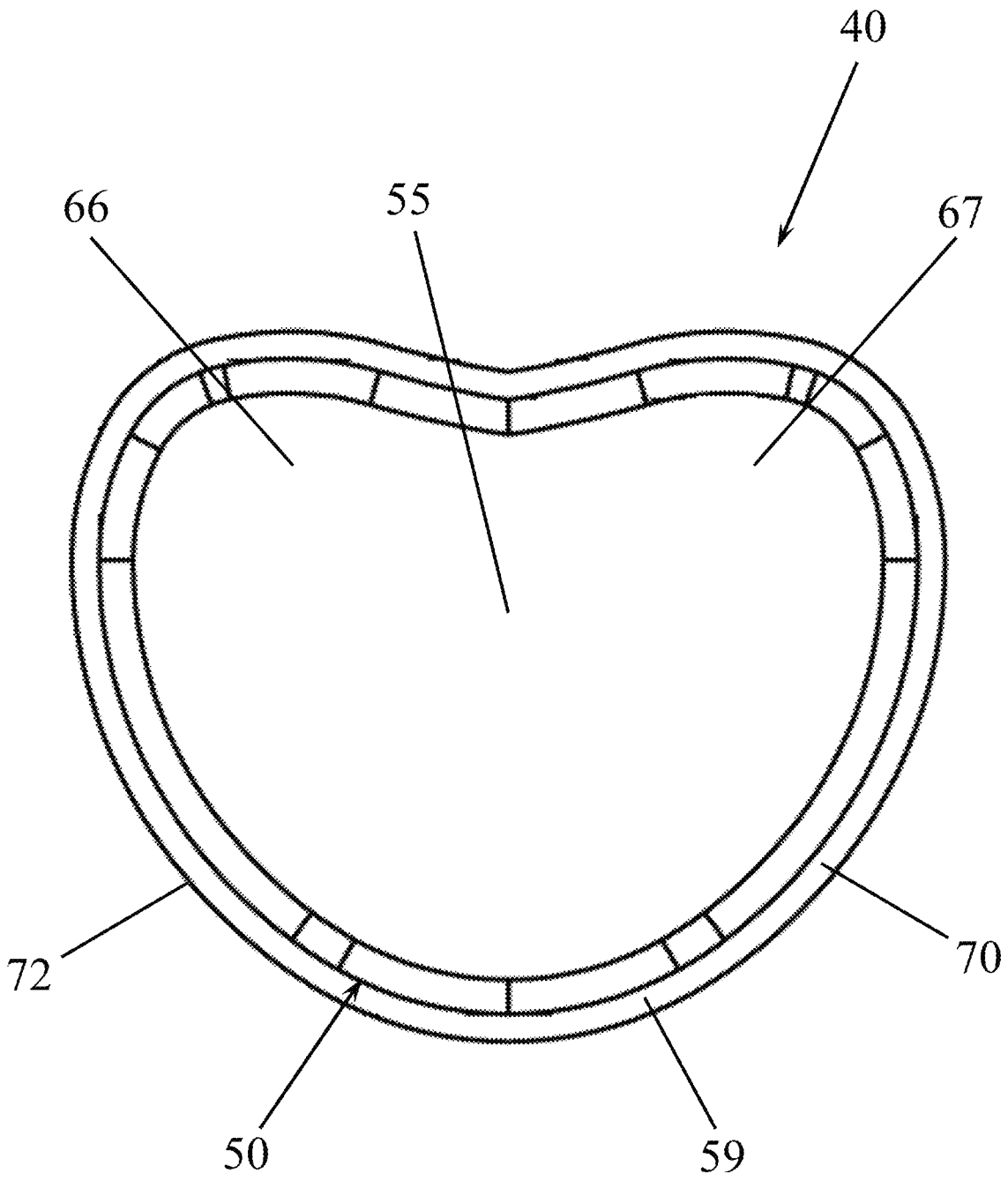
Figure 14C:
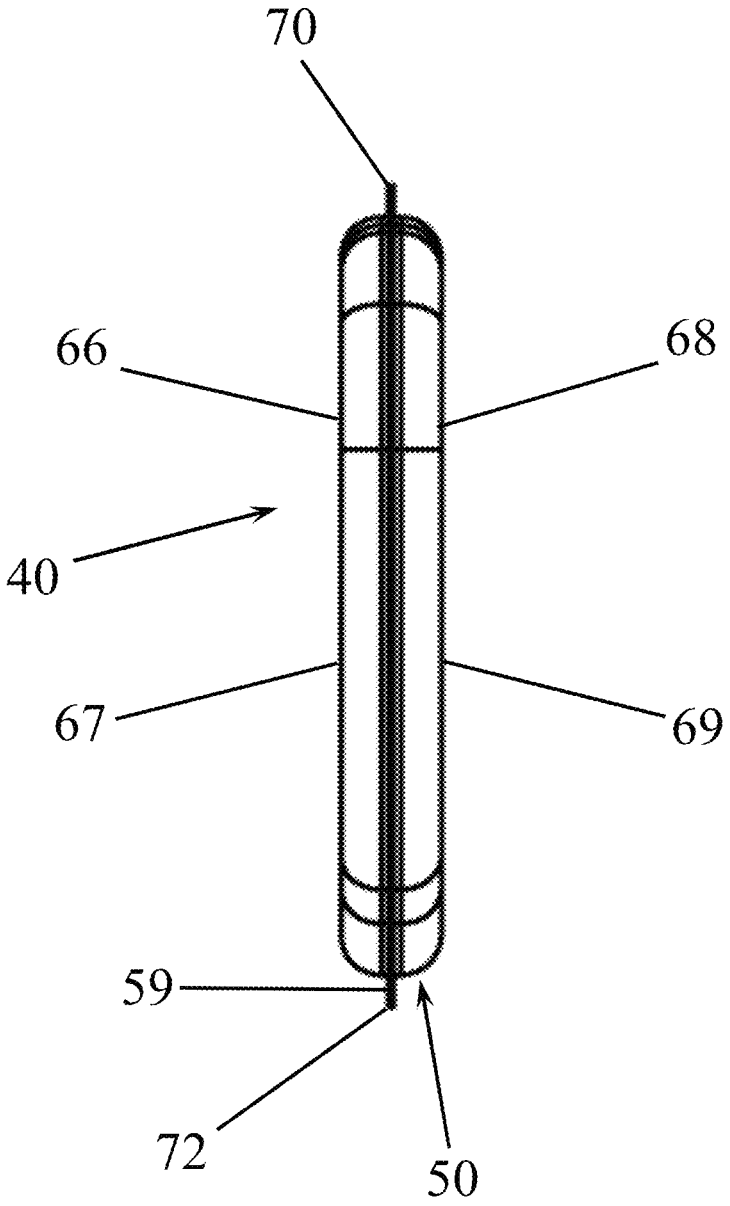
Figure 14D:
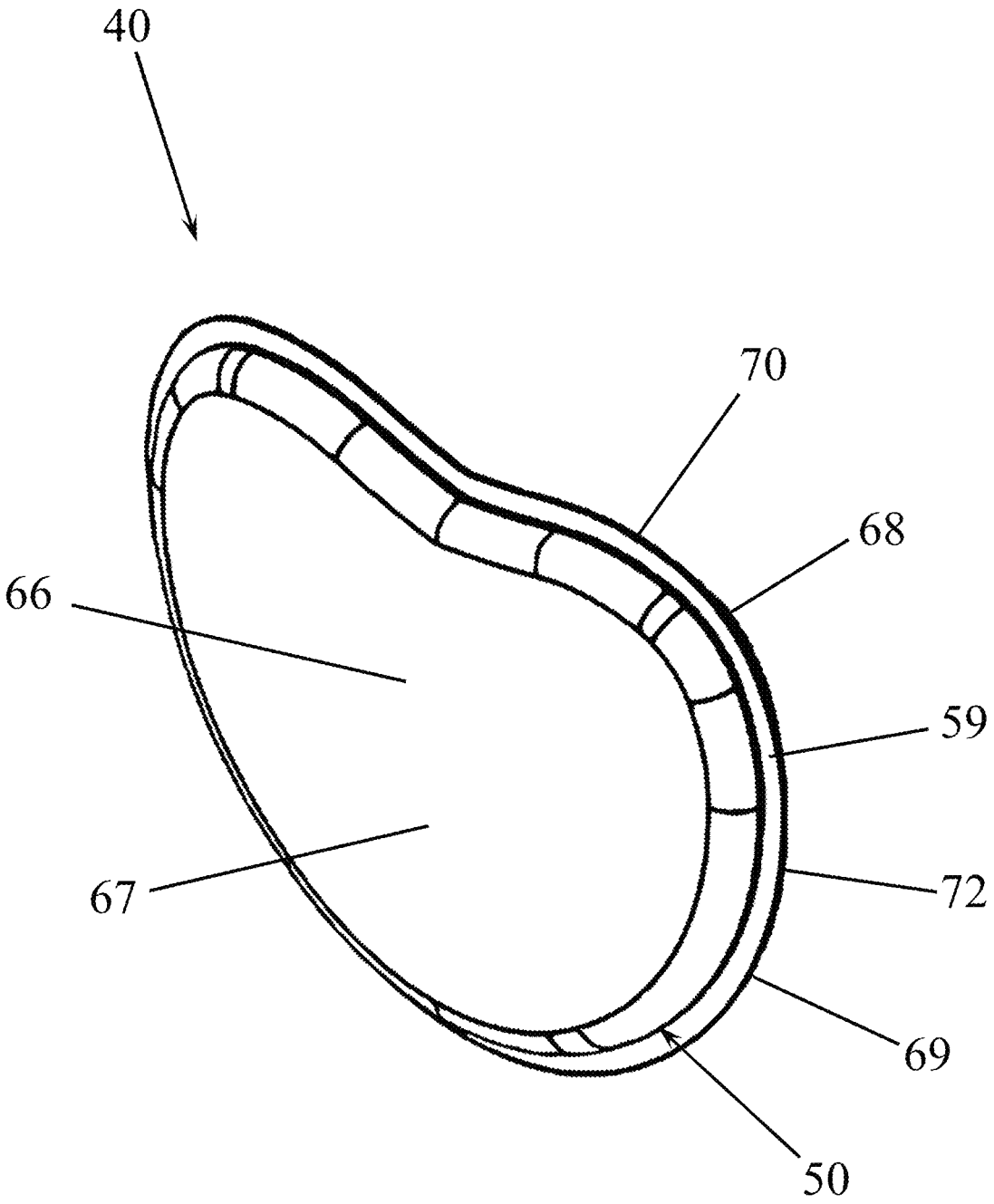
Figure 15A:
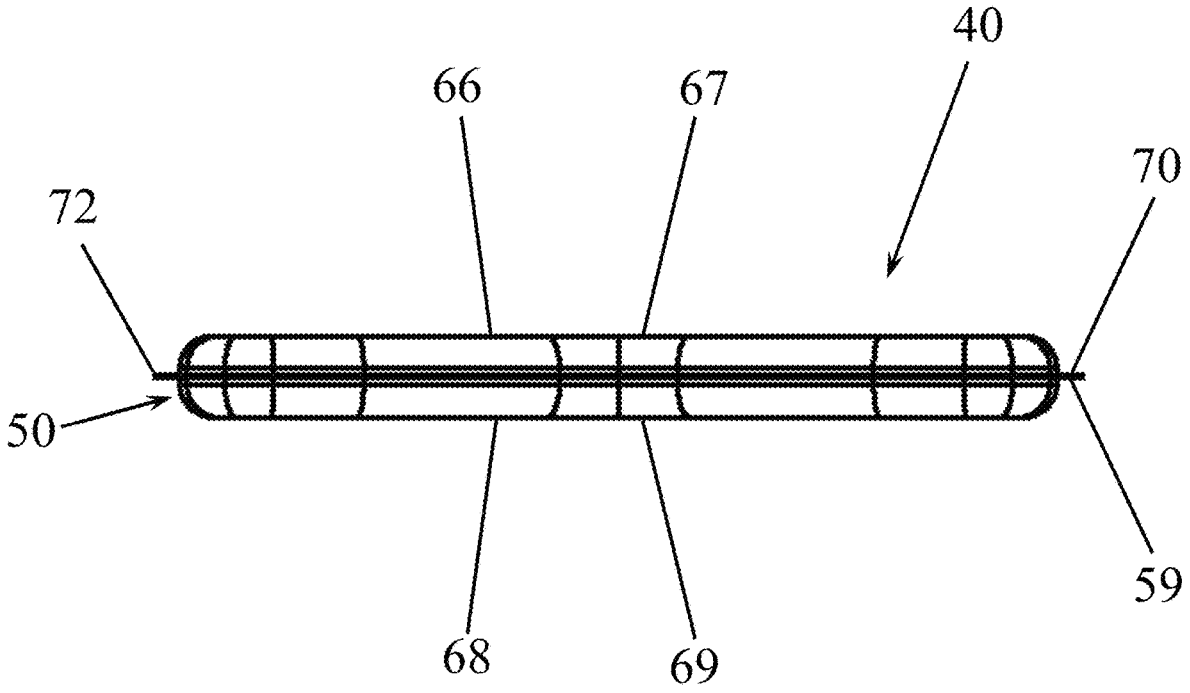
Figure 15B:
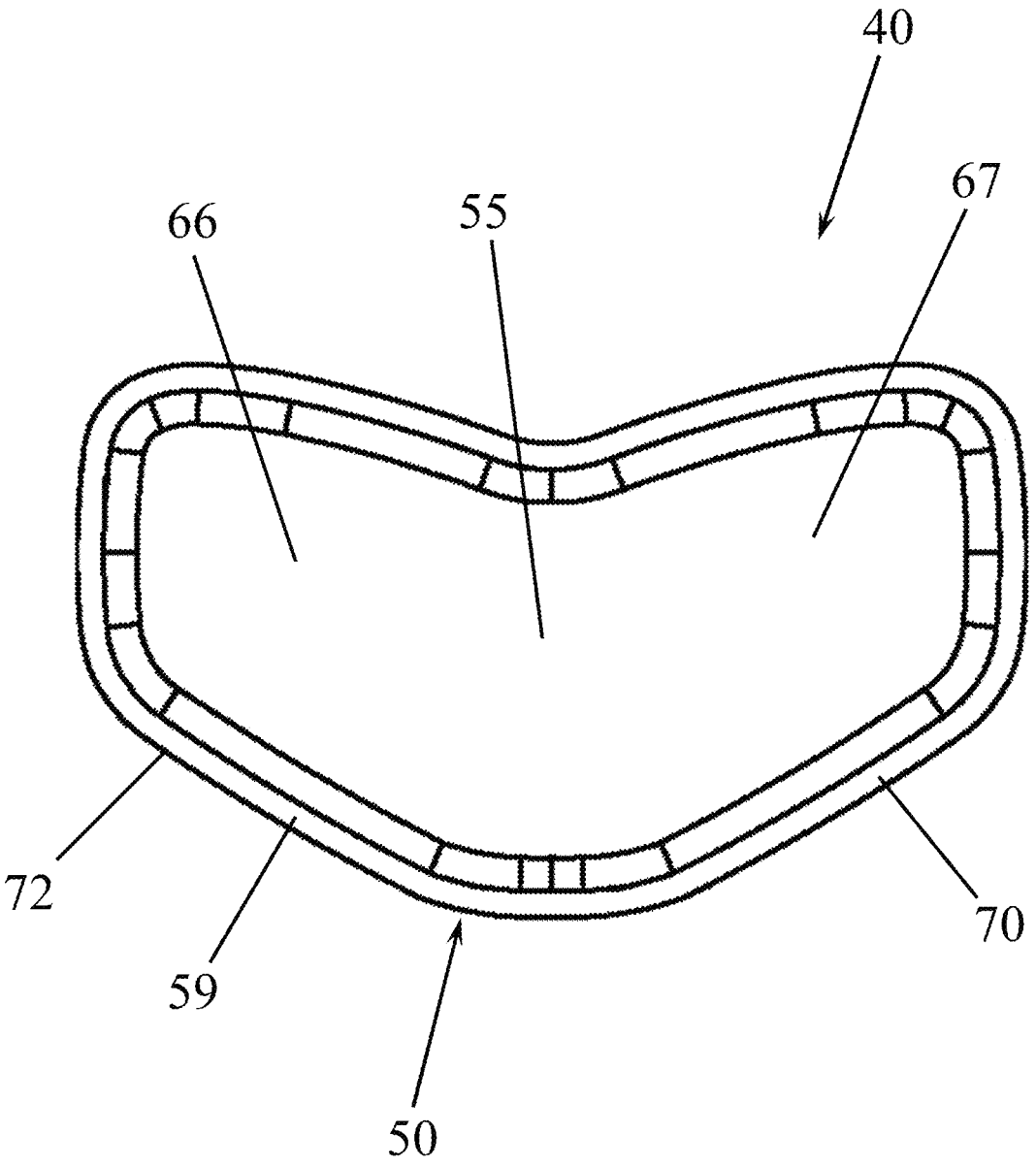
Figure 15C:
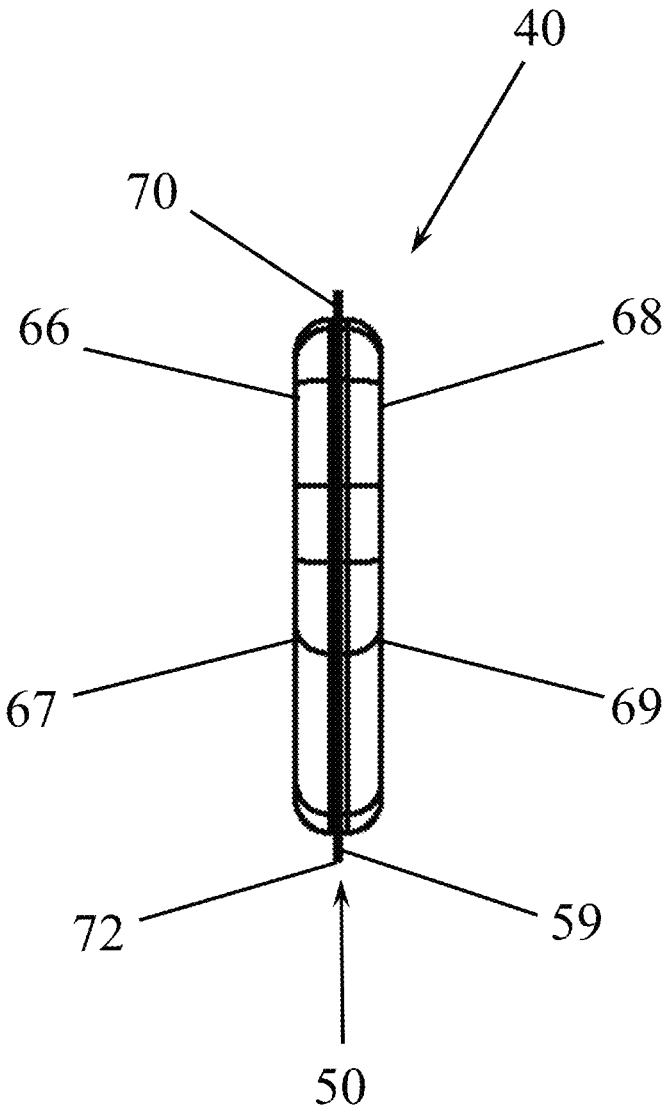
Figure 15D:
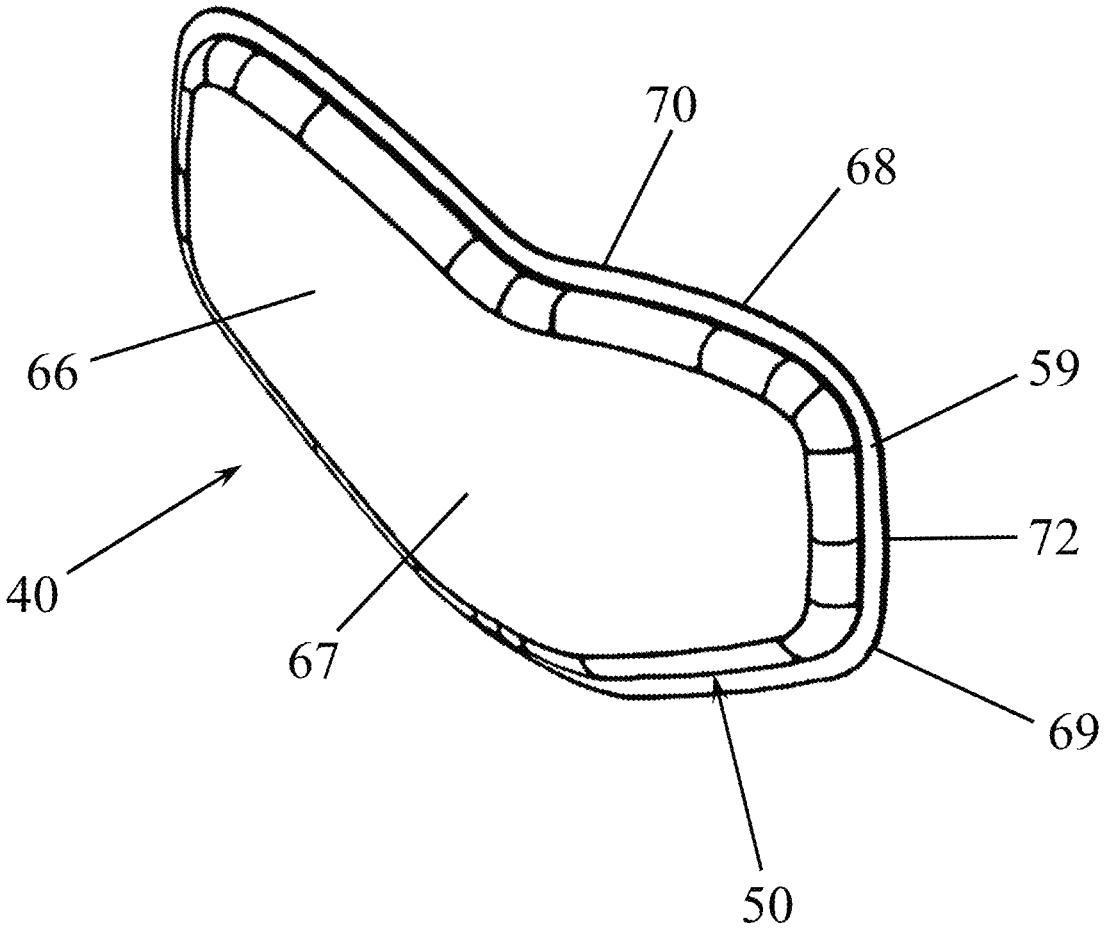
Figure 16A:
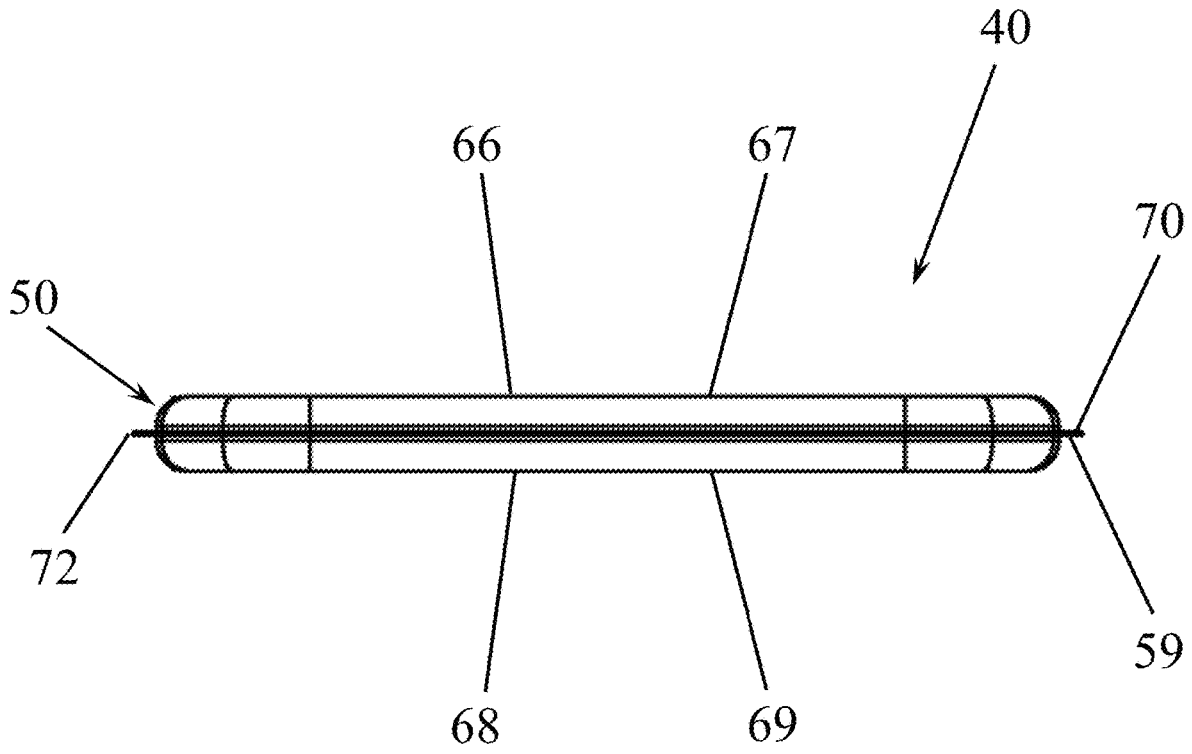
Figure 16B:
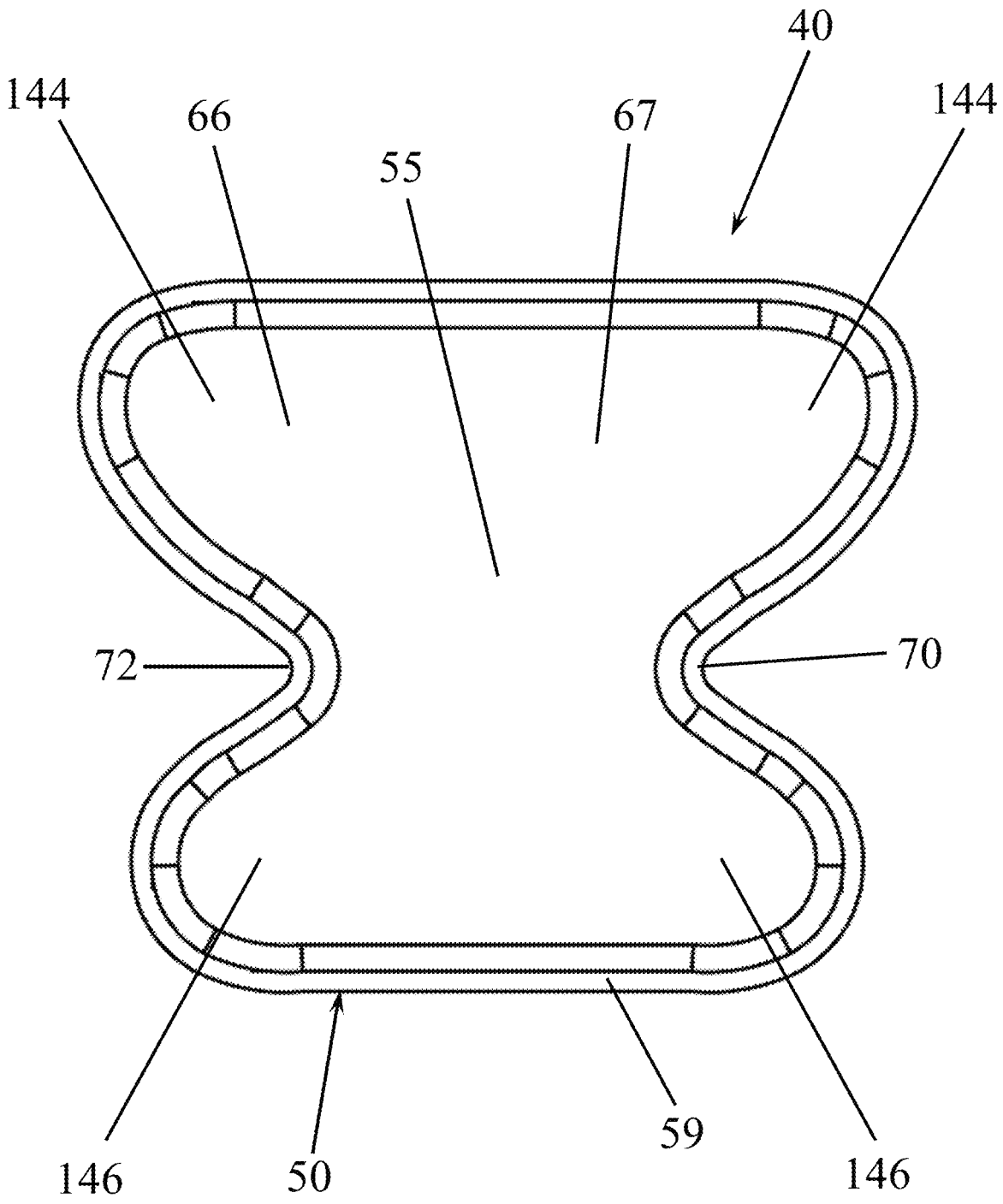
Figure 16C:
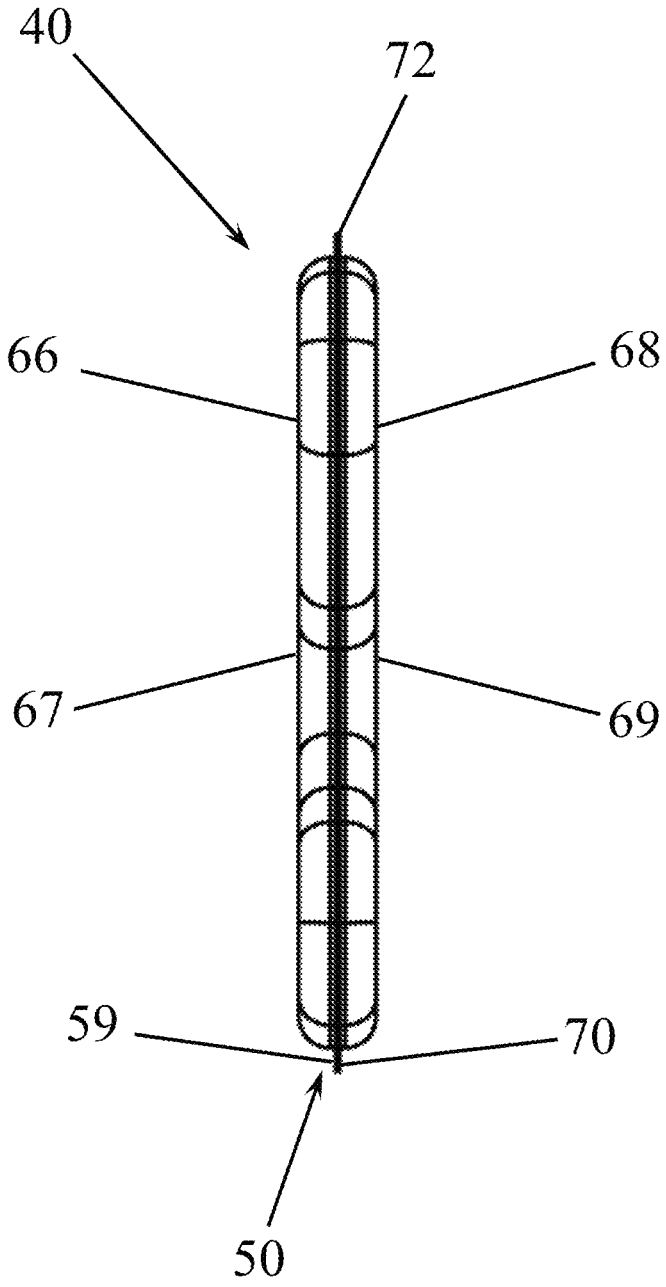
Figure 16D:
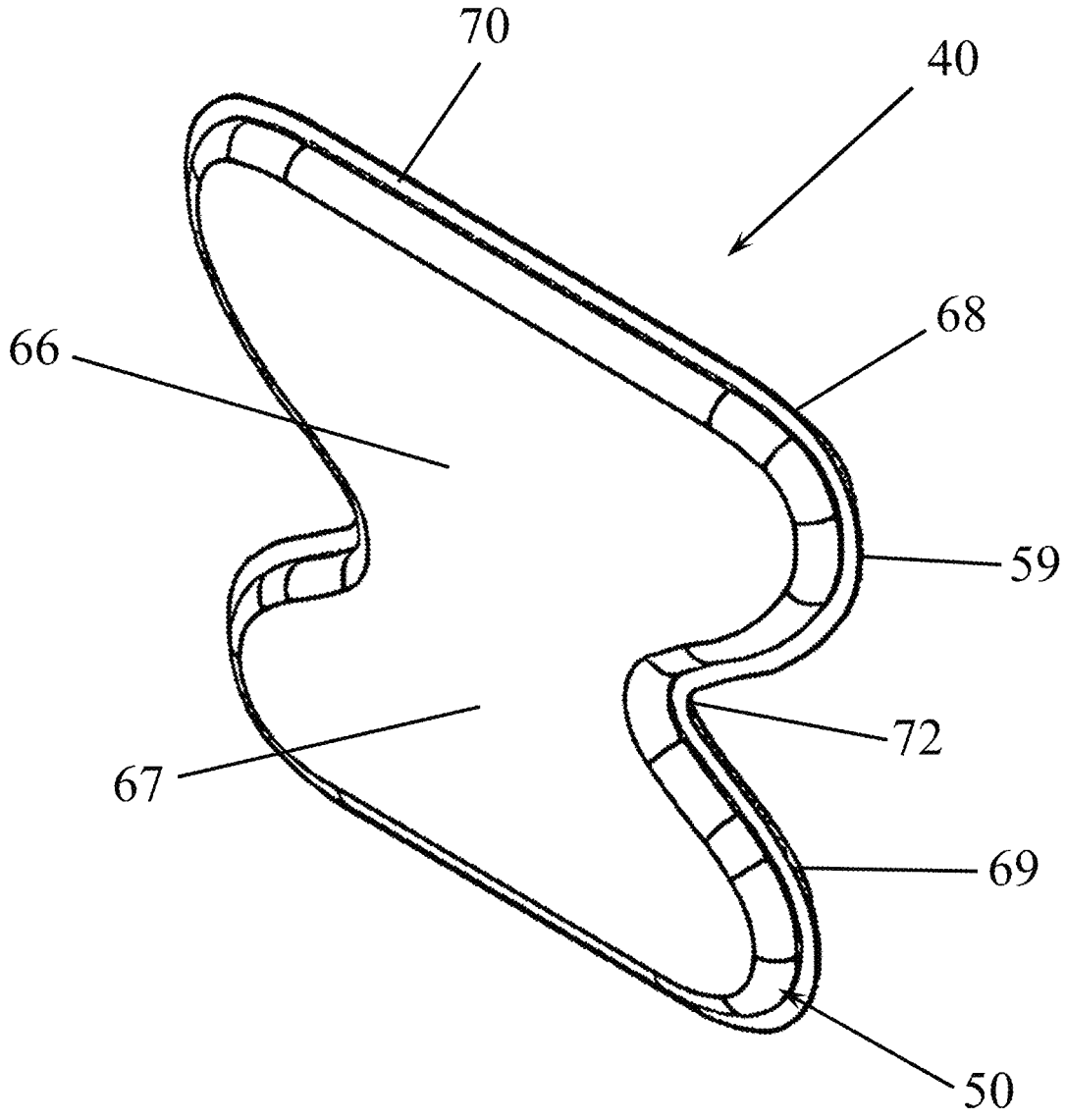
Figure 17A:
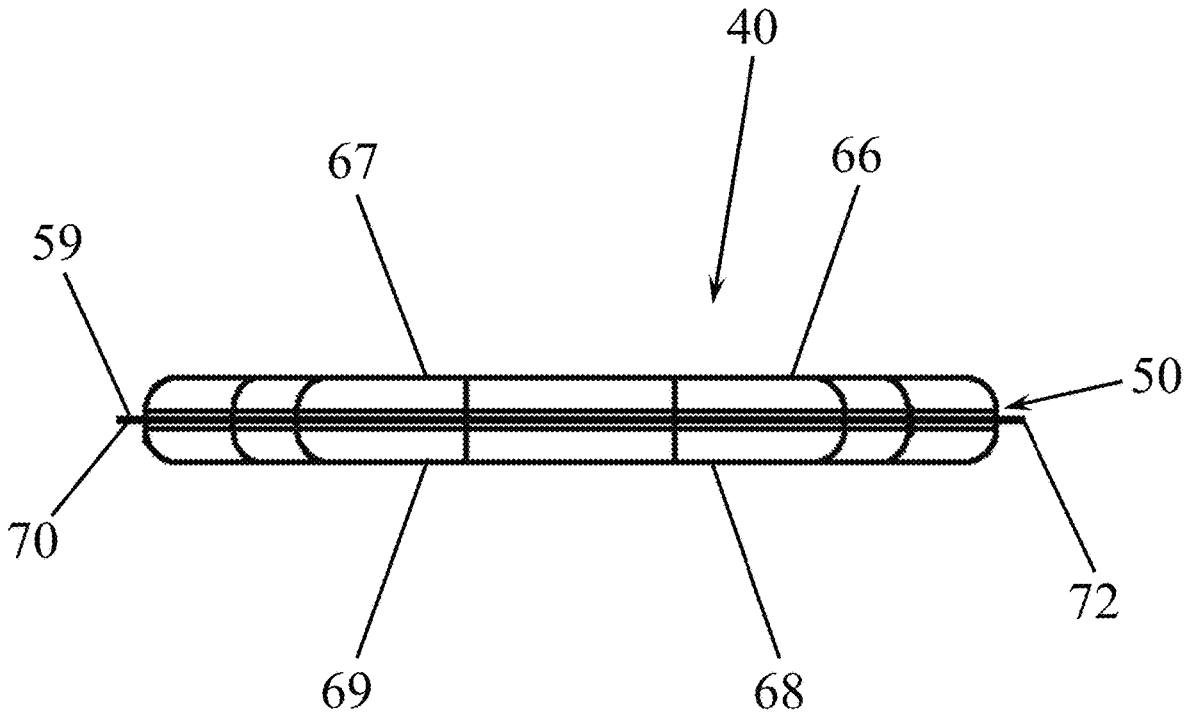
Figure 17B:
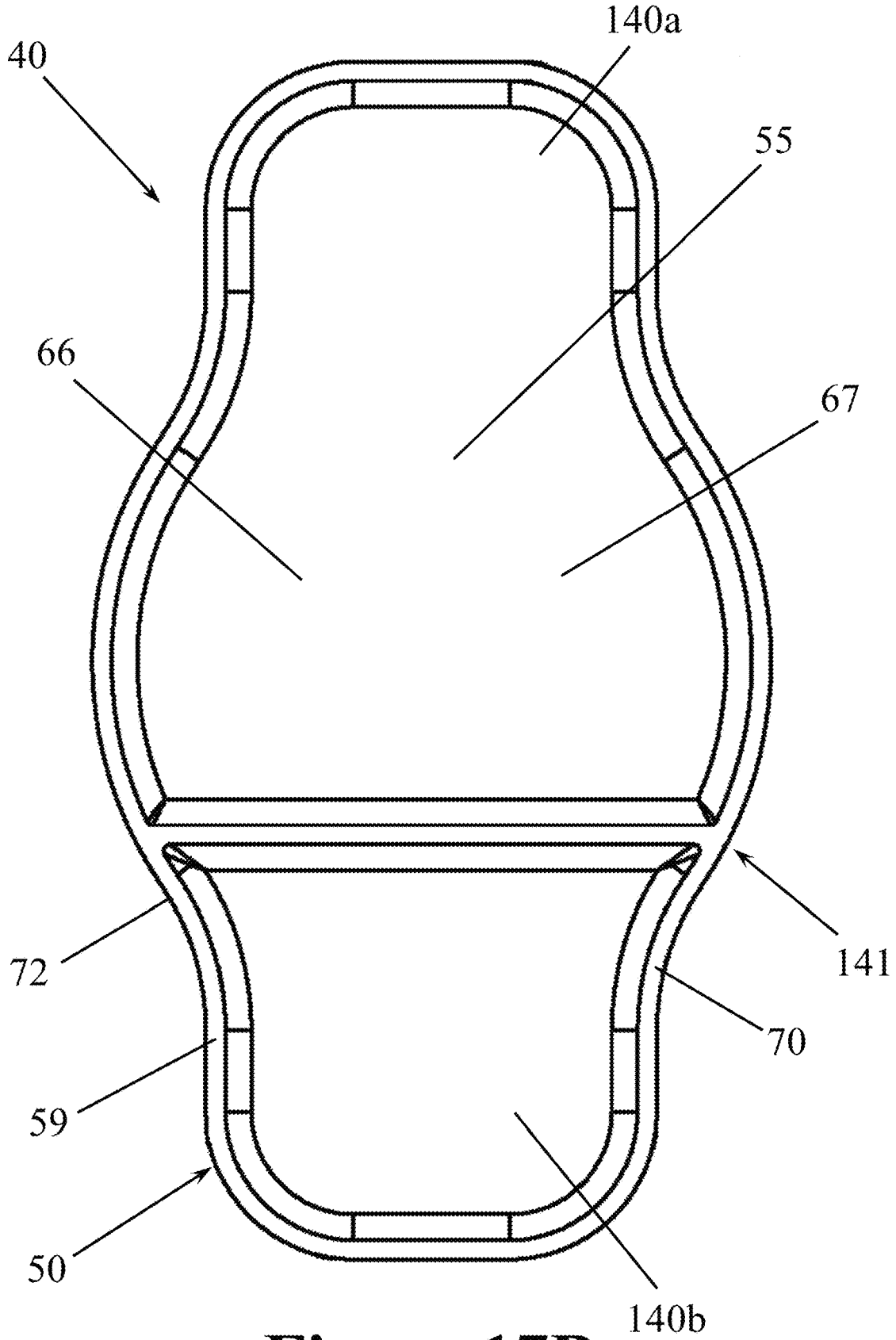
Figure 17C:
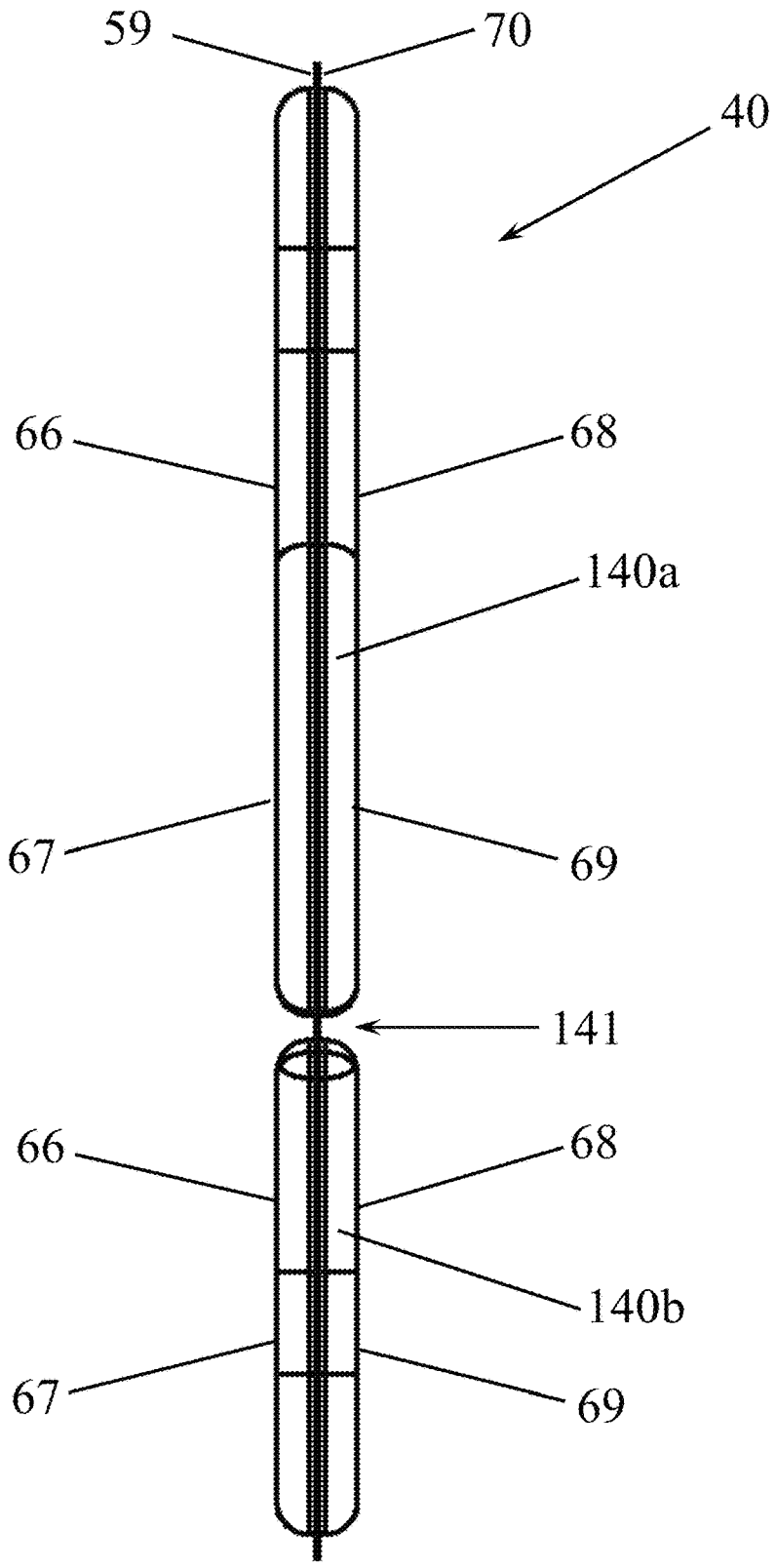
Figure 17D:
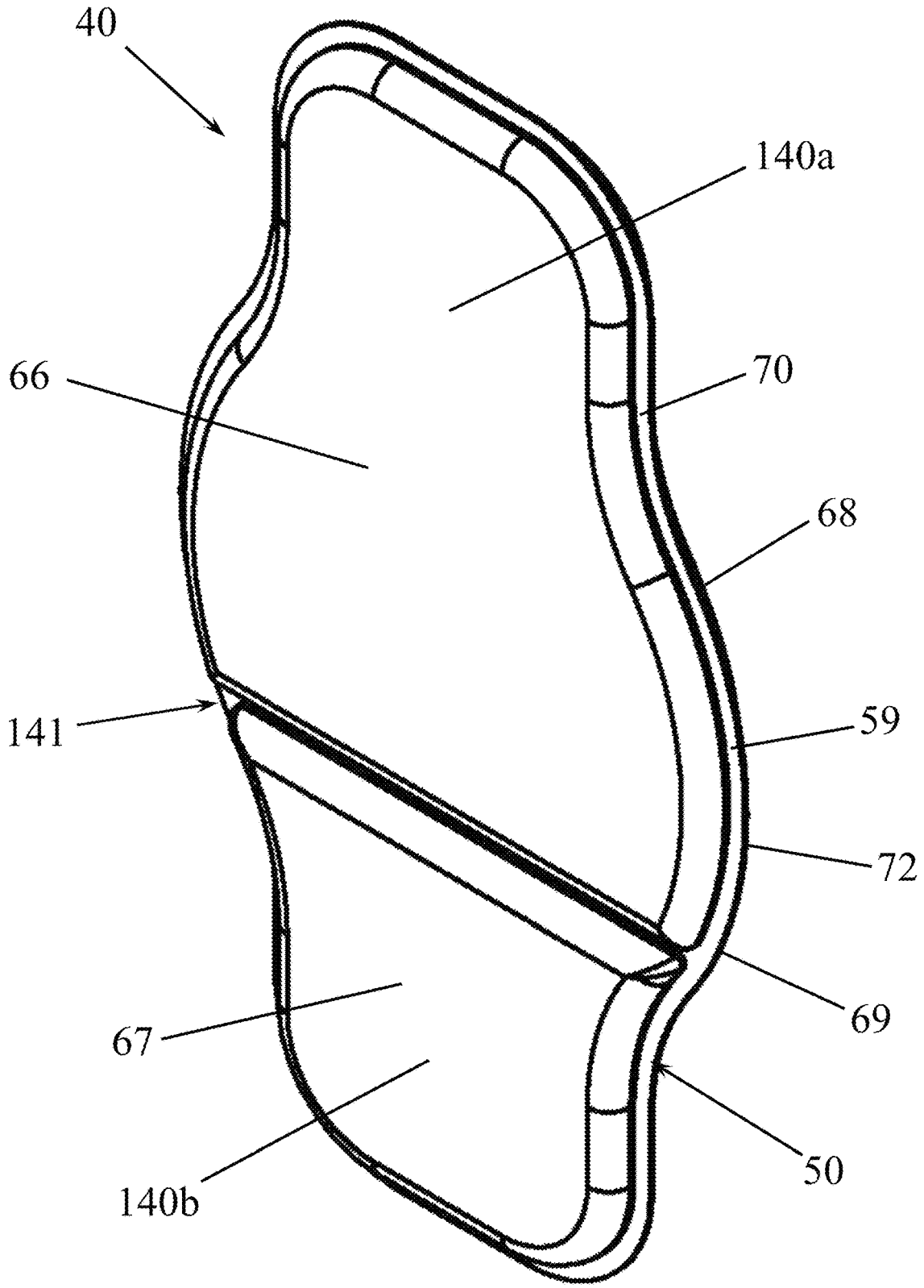

FIG. 11 is a top plan view of the adjustable fitment assembly of FIGS. 8-10 with the fitment adjuster pad extended outwardly from the pocket in the fitment pad carrier in one adjustment position providing greater fitment surface area than when the fitment adjuster pad is fully retracted into the pocket of the fitment pad carrier; and FIG. 12 is a top plan view of the adjustable fitment assembly of FIGS. 8-11 with the fitment adjuster pad disposed in another fitment surface area increasing position where the fitment adjuster pad is extended even farther outwardly from the pocket of the fitment pad carrier than the first fitment surface area increasing position shown in FIG. 11.

FIGS. 13A-13D are a front side view, top plan view, right side view and perspective view of a first embodiment for boots;

FIGS. 14A-14D are a front side view, top plan view, right side view and perspective view of a second embodiment for boots;

FIGS. 15A-15D are a front side view, top plan view, right side view and perspective view of a third embodiment for boots;

FIGS. 16A-16D are a front side view, top plan view, right side view and perspective view of a third embodiment for improved ankle cushioning; and FIGS. 17A-17D are a front side view, top plan view, right side view and perspective view of a fourth embodiment for boots.

Before explaining one or more embodiments of the invention in detail, it is to be understood that the invention is not limited in its application to the details of construction and the arrangement of the components set forth in the following description and illustrated in the drawings. The invention is capable of other embodiments or being practiced or carried out in various ways. Also, it is to be understood that the phraseology and terminology employed herein is for the purpose of description and therefore should not be regarded as limiting.

DETAILED DESCRIPTION

Figure 1:
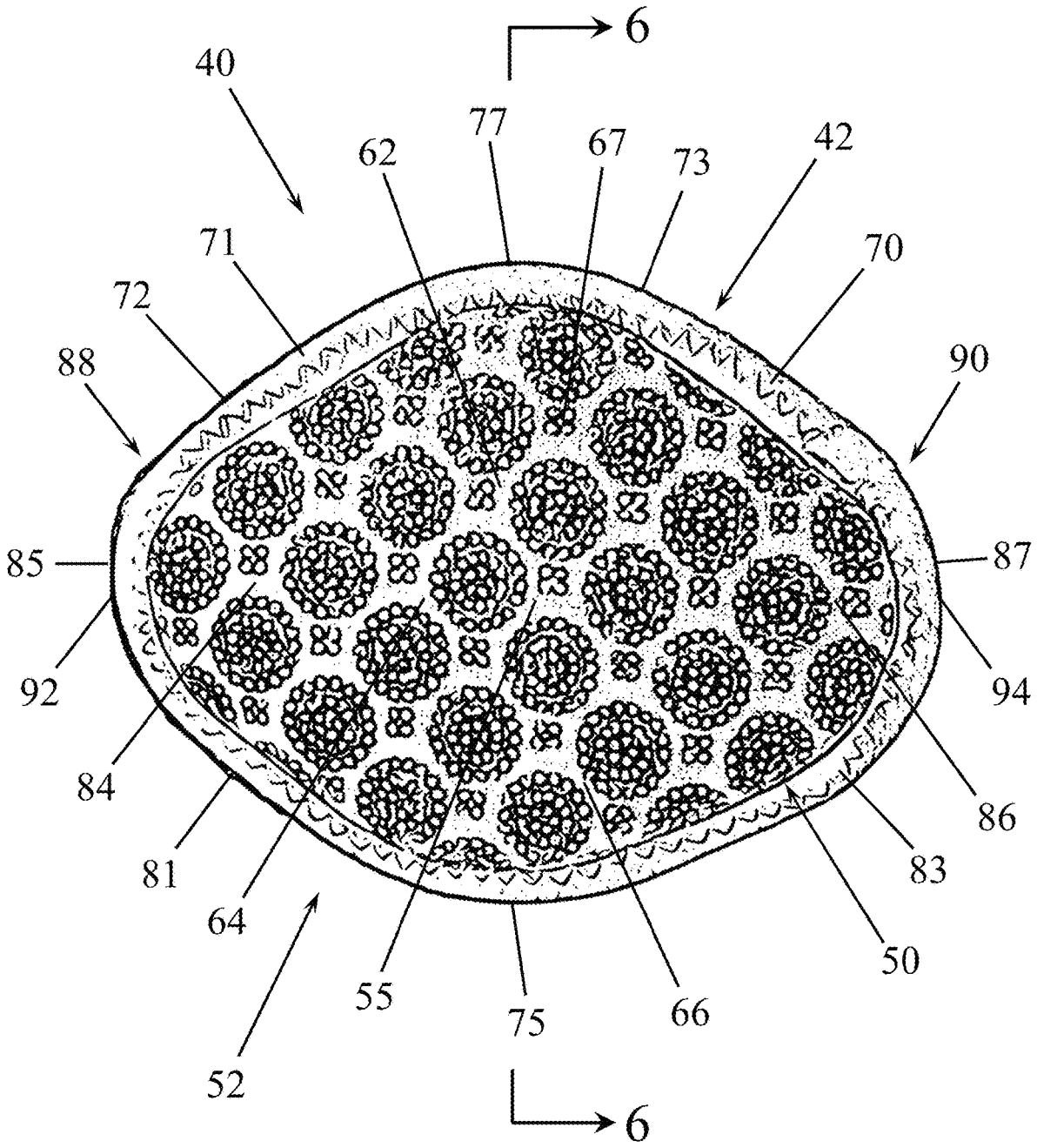
FIG. 1 is a top plan view of a first preferred embodiment of a footwear comfort-enhancing fitment of the present invention.
Figure 2:
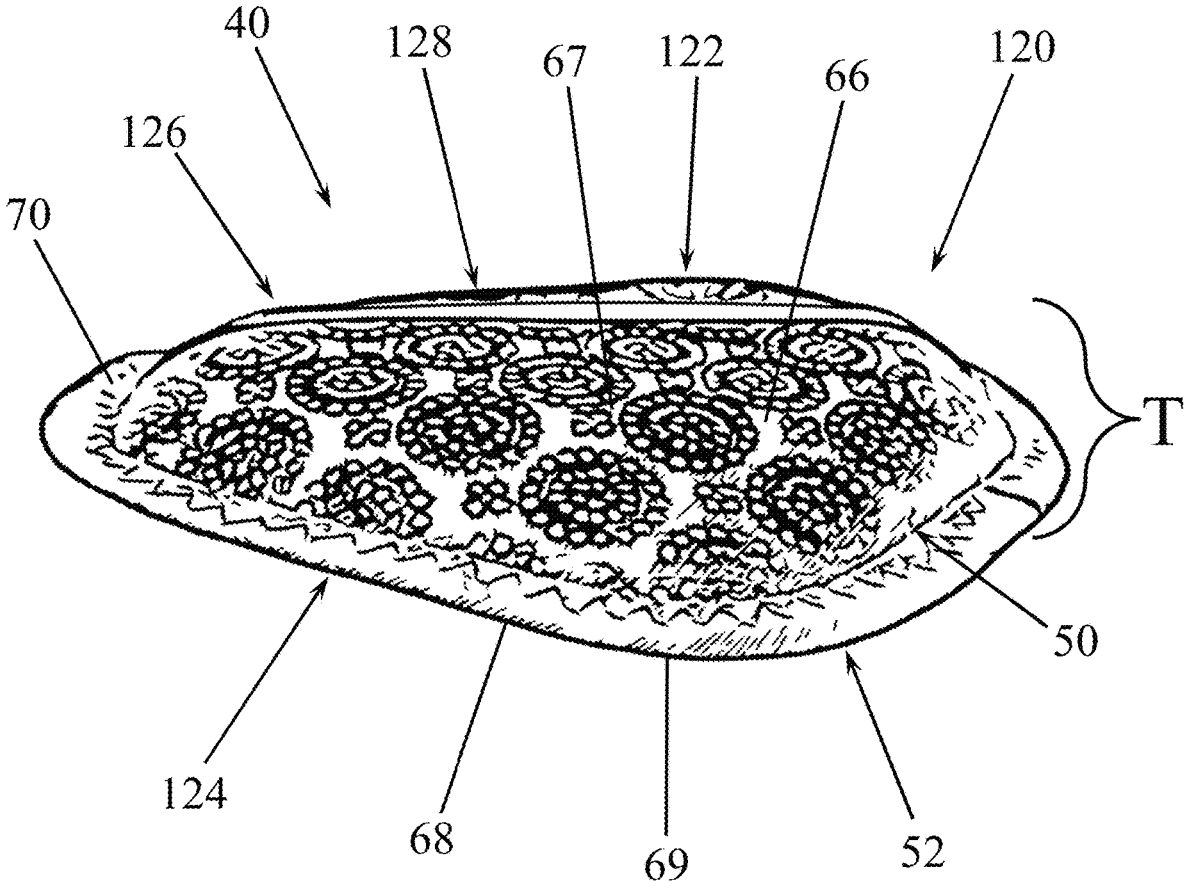
FIG. 2 is a side elevation view of the footwear comfort-enhancing fitment of FIG. 1 depicting its thickness.
Figure 3:
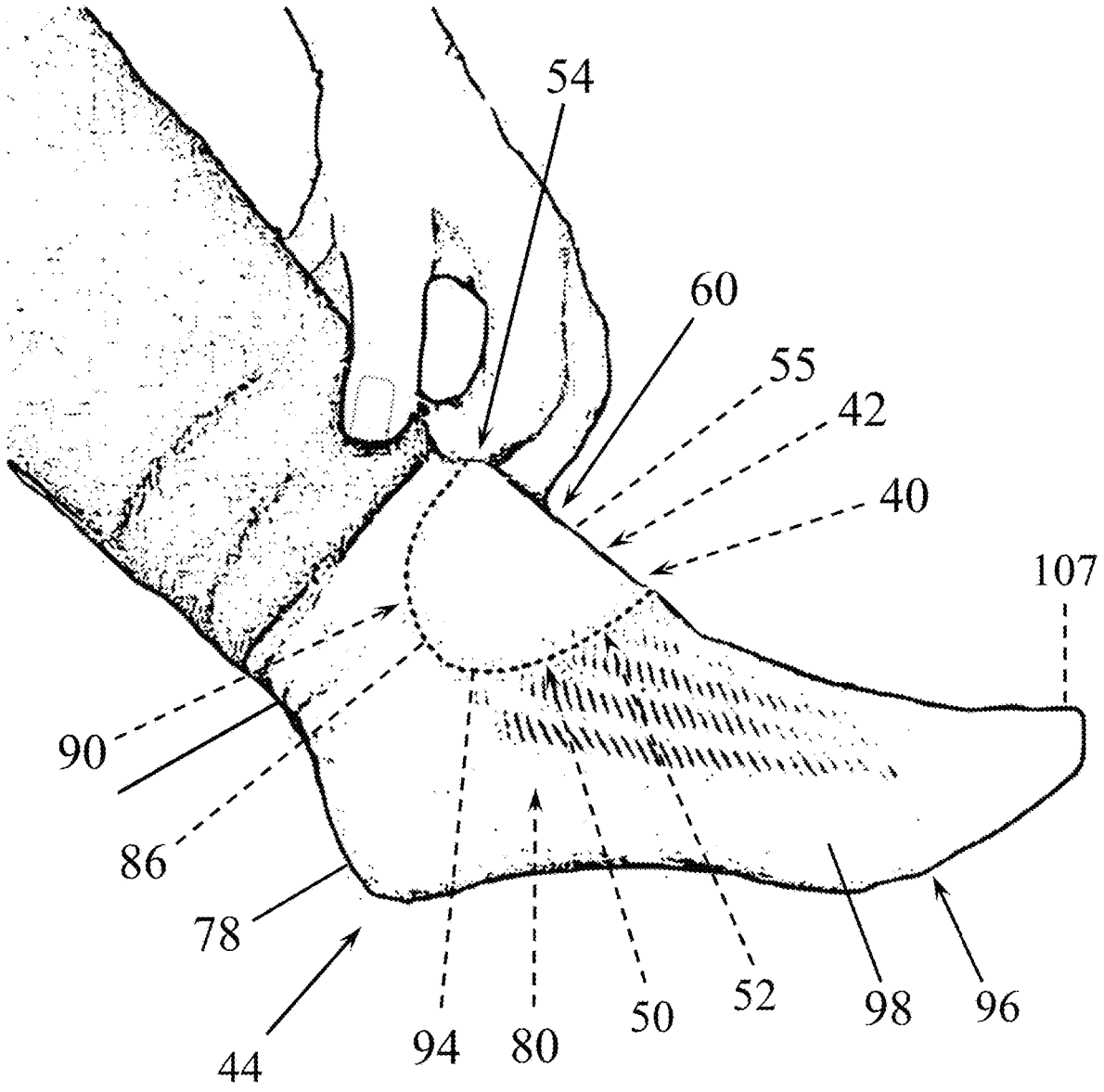
FIG. 3 is a perspective view depicting hosiery on the foot releasably retaining in place the footwear fitment in a preferred position directly against skin of the foot overlying part of the midfoot and/or ankle of the foot.
Figure 4:
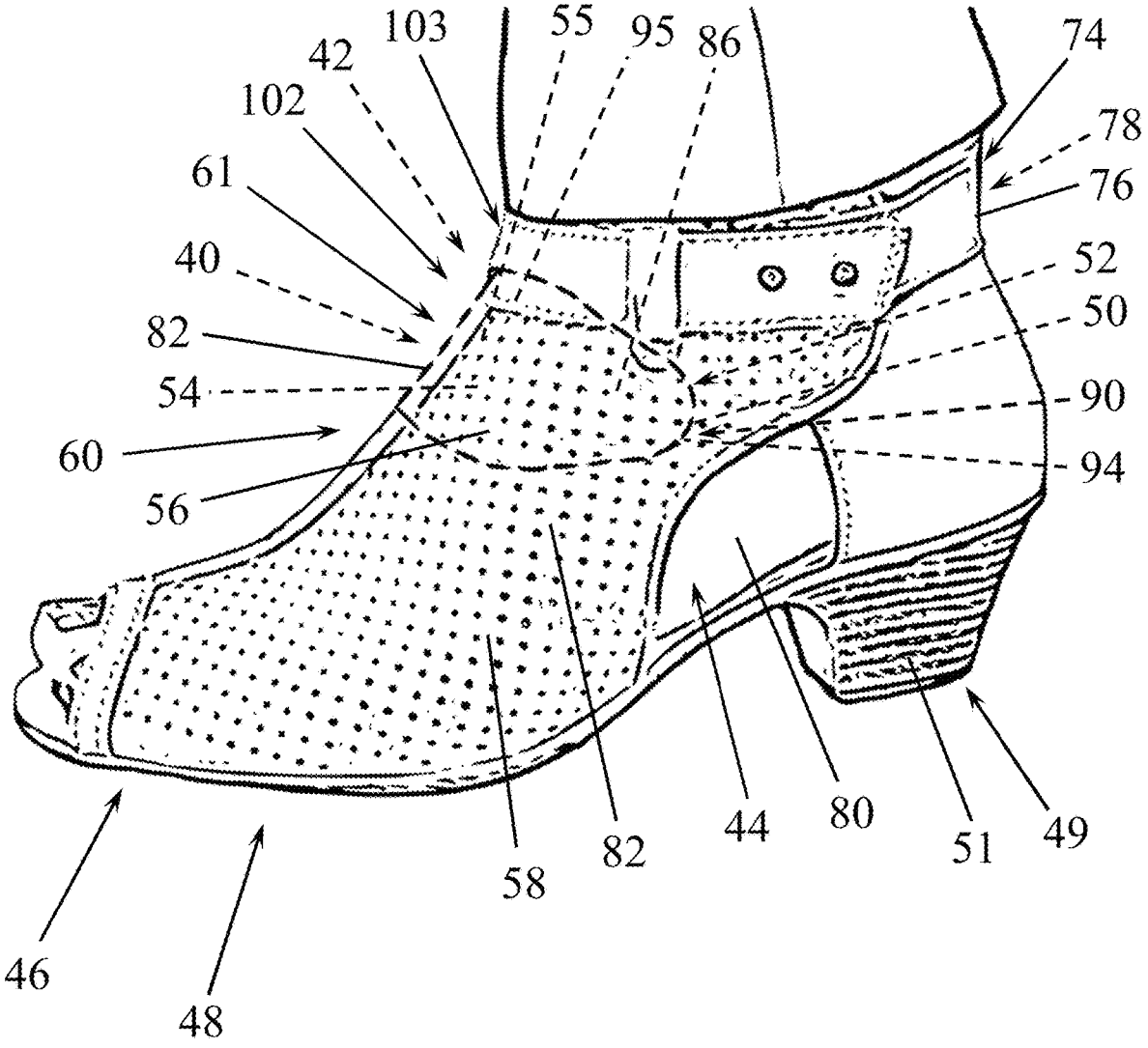
FIG. 4 is a perspective view of an article of footwear worn on a foot of a person with the footwear fitment depicted in phantom removably carried by an upper portion of the foot and disposed between the upper portion of the foot and an upper portion of the footwear.
Figure 5:
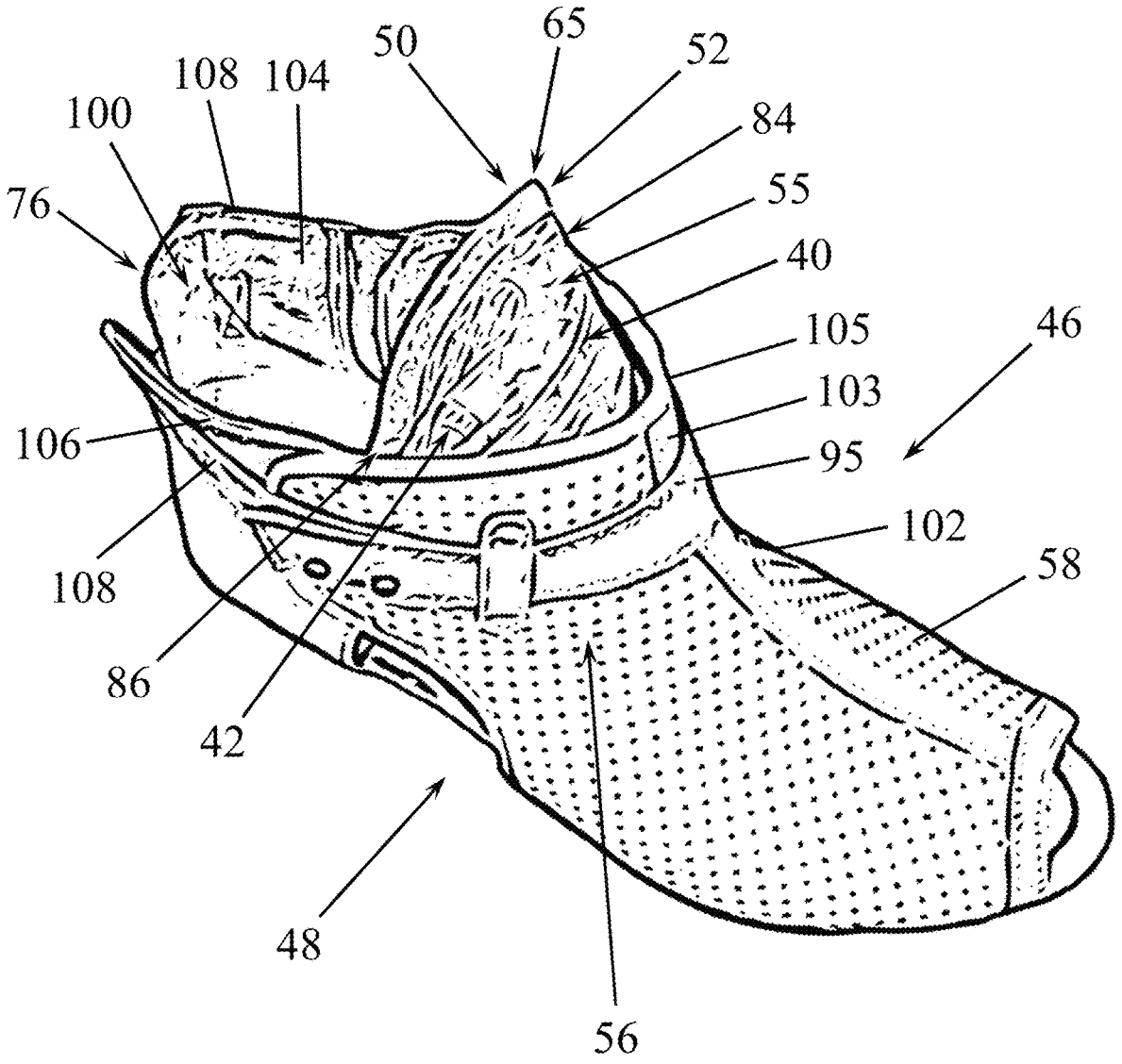
FIG. 5 is a perspective view of the article of footwear with the foot removed showing an exemplary placement of the footwear fitment relative to part of an upper or vamp of the footwear.

FIGS. 1 & 2 illustrate a first preferred embodiment of a flexible foot-conforming footwear comfort-enhancing fitment 40 of the present invention that includes an elongate footwear-snugging pad 42 carried by a foot 44 received in an article of footwear 46, such as heeled shoe 48 shown in FIG. 4, and which has a thickness, T, great enough to take up enough space, e.g., occupy enough volume, between the footwear 46 and foot 44 disposed in the footwear 46 to thereby snug up the footwear 46 around the foot 44 thereby enhancing foot comfort by improving fitment of the footwear 46 on the foot 44. FIG. 3 illustrates the fitment 40 releasably retained in a desired position on the foot 44 by hosiery 96, such as a sock 98, worn on the foot 44 that holds the fitment 40 in place during insertion of the foot 44 in footwear 46 and during walking, running, standing, etc. while wearing the footwear 46. FIG. 4 illustrates an article of footwear 46, such as a shoe 48 that is a heeled shoe 49 equipped with a heel 51, worn on the foot 44 with the hosiery 96 covering the fitment 40 holding the fitment 40 in place between an upper portion of the foot 44 and an upper portion of the shoe 48 with the upper 102 or vamp 103 of the shoe 48 completely overlying the fitment 40. FIG. 5 depicts the shoe 48 with the foot 44 removed and the fitment 40 positioned to illustrate an exemplary alternative positioning of the fitment 40 relative to an upper or top part of an upper 102 or vamp 103 of the shoe 48.

With reference once again to FIGS. 1 & 2, a footwear comfort-enhancing fitment 40 constructed in accordance with the present invention preferably also helps more optimally position one of the foot 44 received in footwear 46 relative to the footwear 46 and the footwear 46 worn on the foot 44 relative to the foot 44 thereby advantageously helping improve foot comfort. While the article of footwear 46 shown in FIG. 4 is a heeled shoe 49, a footwear comfort-enhancing fitment 40 constructed in accordance with the present invention is also well suited for use with other types of footwear 46 to enhance foot comfort, including high-heeled shoes, athletic or sports shoes, dress shoes, boots, high-heeled boots, and other types of footwear.

Such a footwear comfort-enhancing fitment 40 of the present invention also is flexible, so as to be foot-conforming, and oblong, so at least part of the fitment 40 underlies an upper portion of the footwear 46 worn on a foot 44 carrying the fitment 40. The fitment 40 is formed with a footwear-snugging pad 42 that has a thickness sufficient to displace an adjacent upper portion of the footwear 46 overlying the fitment 40 to snug up the footwear 46 around the foot 44, is flexible to conform to a three-dimensionally contoured shape of an upper portion of the foot 44 carrying the fitment 40, is resilient for maintaining sufficient thickness to ensure continued snugging of the footwear 46 during months and preferably years of use of the fitment 40, and is padded or cushioned to help ensure that the fitment 40 itself is comfortable to wear.

The flexible, resilient, cushioned shoe snugging pad 42 of the fitment 40 has a thickness, T, which enables the pad 42 to help snug the footwear 46 on the foot 44 thereby advantageously helping prevent sliding relative movement between the foot 44 and footwear 46 worn on the foot 44 even when the pad 42 is substantially compressed between the foot 44 and the footwear 46 by the pad 42 functioning as a spacer 52 that spaces at least an adjacent portion of a top portion of an upper 102 or vamp 103 of the footwear 46 (FIG. 5) away from at least an adjacent upper portion 61 of a midfoot region 60 of the foot 44 carrying the pad 42. By snugging up the footwear 46 around at least part the foot 44 carrying the footwear-snugging pad 42, the fitment 40 not only helps improve comfort by more properly locating the foot 44 within the footwear 46 by helping reposition the foot 44 at least slightly within the footwear 46, but the fitment 40 also helps snug up the footwear 46 around the foot 44 improving the comfort by improving fit. Such a footwear comfort-enhancing fitment 40 of the present invention advantageously is flexible and thereby foot-conformable in that the fitment 40, including its footwear snugging pad 42, is able to three-dimensionally conform to the three-dimensional contour of the upper portion 61 of the midfoot region 60 of the foot 44 carrying or wearing the fitment 40.

The fitment 40 is made of at least a plurality, preferably at least a plurality of pairs of, i.e., at least three, layers 66, 68 with a preferred fitment 40 having a pair of durable, flexible and resilient outer cloth or fabric layers 66, 68 and at least one thickness-providing inner layer not shown in FIGS. 1 & 2 that is sandwiched between the outer layers 66, 68 with the inner layer providing the pad 42 with sufficient thickness, T, even when compressed to a minimum thickness between the foot 44 and footwear 46, to function as a foot-locating spacer 52 that spaces at least part of the footwear 46 adjacent the fitment 40 away from part of the foot 44 wearing the fitment 40. By spacing at least part of the footwear 46 adjacent the fitment 40 away from part of the foot 44 over which the fitment 40 overlies, the fitment 40 advantageously helps more optimally locate the foot 44 in the footwear 46 preferably helping to prevent impact of one or more toes 107 of the foot 44 The at least one thickness-providing inner layer disposed between outer layers 66, 68 also imparts the pad 42 of the fitment 40 with sufficient thickness, T, even when compressed to a minimum thickness as a result of being disposed between the foot 44 and footwear 46, to serve as a foot-snugging pad 42 that snugs up at least some and preferably substantially all looseness in fit of the footwear 46 around the foot 44 thereby advantageously improving comfort by improving fit.

With continued reference to the fitment embodiment of FIGS. 1 & 2, at least the outer layers 66, 68 of the fitment 40 are joined together by a seam, hem or stitching about the periphery of the pad 42 forming a border 70 of the fitment 40 that extends around the at least one internal layer forming the pad 42 with the border 70 preferably also defining an outer peripheral edge 72 of the fitment 40. With specific reference to FIG. 2, one outer layer 66 of the fitment 40 extends along and helps define with the pad 42 formed by the at least one inner layer a first generally planar or flat outer surface 67 facing toward the footwear 46 when the fitment 40 is worn on the foot 44 during fitment use and operation. Likewise, the other outer layer 68 extends along and helps define with the pad 42 formed by the at least one inner layer a second generally planar or flat outer surface 69 facing toward the foot 44 when the fitment 40 is worn on the foot 44 during fitment use and operation. With continued reference to FIG. 2, the outer surfaces 67, 69 of the fitment 40 that preferably are defined by the pad 42 can be generally parallel to one another.

Although not shown in the preferred fitment embodiment depicted in FIGS. 1 & 2, sandwiched between the outer fabric or cloth layers of the pad 42 is at least a plurality, preferably at least a plurality of pairs of, i.e., at least three, layers of at least one of a fibrous material, a non-woven material, a felt, fabric, cloth, batting, or another type of suitable material whose overlapping layers give the pad 42 a desired footwear-spacing thickness when disposed between part of a foot 44 and an adjacent part of the footwear 46 worn by or on the foot 42. Such thickness-providing inner layer(s) of the pad 42 also advantageously impart padding and/or cushioning to the pad 42 thereby helping to resiliently conform to three-dimensionally contoured surfaces of part of the foot 44 and part of the footwear 46, e.g., part of shoe 48, enabling placement of the pad 42 nearly anywhere within the footwear 46, e.g., within shoe 48, alongside foot 44. Such one or more inner layers of the pad 42 define a pad 42 within the fitment 40 having a minimum cross-sectional thickness 50 of at least five millimeters, preferably at least seven millimeters, more preferably at least nine millimeters when the fitment 40, specifically the pad 42 of the fitment 40, is compressed to its minimum thickness inboard of the edging or border 70 crucially configuring the fitment 40, specifically the pad 42, with sufficient thickness 50 to space part of the footwear 46 away from the foot 44 to help restore proper location of the foot 44 in the footwear 46. Such one or more inner layers of the pad 42 define a pad 42 having a maximum uncompressed cross-sectional thickness 50 of at least nine millimeters, preferably at least ten millimeters, more preferably at least twelve millimeters, when the portion of the pad 42 inwardly or inboard of the edging or border 70 is uncompressed advantageously enabling the pad 42 to accommodate slight spacing differences between the foot and footwear along where the pad 42 is disposed therebetween. Such a flexible and compressible construction also advantageously enables the fitment 40, particularly the pad 42 inside the fitment 40, to conform to both the three-dimensional contour of the top of the foot 44 and the interior of the top portion of the upper 102 or vamp 103 of the footwear 46, e.g., shoe. In addition, such one or more layers that form the pad 42 inside the fitment 40 provide advantageous shock-absorbing cushioning between the foot 44 and footwear 46, e.g., shoe 48, helping cushion the foot 44 from shocks, particularly fore-aft or proximal-medial transmitted shocks, impacts, particularly fore-aft or proximal-medial transmitted impacts, vibration, particularly fore-aft or proximal-medial transmitted vibration, and the like experienced when using the fitment 40 while wearing the footwear 46, e.g., shoe 48, during walking, dancing, jogging and/or running. In one preferred embodiment, each inner layer forming the pad 42 is composed of cotton and/or wool, such as preferably organic cotton and/or organic wool, with each inner layer and the outer layers 66, 68 of the fitment 40 being machine washable and machine dryable producing a machine-washable footwear-locating fitment 40 of the invention that is reusable.

With continued reference to FIGS. 1 & 2, such a footwear-snugging fitment 40 of the present invention has a flexible, cushioned, compressible, resilient, and oblong, foot- locating footwear-snugging pad 42 making the fitment 40 well suited for use with footwear 46, e.g., an article of footwear 46, that is a shoe 48, like the heel- equipped shoe 49 depicted in FIGS. 4 & 5, which can be a high-heeled shoe with a heel longer and narrower than the heel 51 shown in FIG. 4. Such a fitment 40 of the invention also is well suited for use with other types of footwear 46, e.g., articles of footwear 46, such as a boot, that can also be equipped with a heel, such as a high-heeled boot having a tapering heel longer and narrower than the heel 51 of the shoe 48 shown in FIG. 4. As such, such a flexible foot and shoe conforming fitment 40 of the present invention and its footwear-snugging pad 42 are well suited for use with virtually all types of footwear, including women's high-heeled shoes, high-heeled boots, athletic shoes, tennis shoes, baseball and football spikes or cleats, basketball shoes, men's dress shoes, women's dress shoes, steel-toed work shoes and boots, hunting boots, duck boots, hip boots, waders as well as other types of footwear.

With specific reference to FIG. 4, the fitment 40 and its shoe-snugging pad 42 are shown in phantom in FIG. 2 disposed between a top portion 54 of the foot 44 and a top portion 56, preferably a top part of the upper 102 or vamp 102, of the shoe 48, such that the fitment 40 and its pad 42 underlie the top portion 56, preferably top part of the upper 102 or vamp 103, of the shoe 48. With additional reference to FIG. 3, the fitment 40 and its shoe-snugging pad 42 are elongate, oblong, and configured for being positioned with the lengthwise extent of the fitment 40 and pad 42 oriented as depicted in FIGS. 3 & 4 generally transverse relative to a fore-aft or proximal-medial longitudinal direction of the foot 44 received within the shoe 48. The fore-aft or proximal-medial direction is defined as the direction defined or extending between a heel 78 and toes 107 of the foot 44. When the fitment 40 is transversely oriented as shown in FIGS. 3 & 4, the thickness 50 provided by the pad 42 in the fitment 40 results in the pad 42 defining a shoe-locating spacer 52 disposed within the shoe 48 located between the foot 44 and the shoe 48. When the pad 42 is disposed as depicted in phantom in FIG. 4 oriented with its lengthwise direction generally orthogonal to the longitudinal direction of the shoe 48, the thickness 50 of the pad 42 results in the pad 42 defining a front-shoe displacing spacer 52 that spaces a top front or top forward portion 56 of the shoe 48, e.g., front portion of the upper 102 or vamp 103 of the shoe 48, outwardly in a forward, fore-aft, or proximal-medial direction relative to and from a top front or top forward portion 54 of the foot 44, preferably a midfoot 60 of the foot 44.

Where there previously was shoe-foot mislocation when the foot 44 was received within the shoe 48 without use of any fitment 40, such shoe-foot mislocation can undesirably allow relative movement between the foot 44 and shoe 48 to occur during walking, running or the like causing foot fatigue, and which can further result in rubbing, blistering, bruising, or other foot discomfort or even foot injury occurring from walking, dancing, jogging or running. Where the shoe-foot mislocation is fore-aft shoe-foot mislocation, relative movement occurs between the foot 44 and shoe 48 is in a longitudinal or fore-aft direction where the foot 44 slides or moves relative to the shoe 48 within the shoe 48 forwardly and/or rearwardly during walking, dancing, jogging or running causing foot fatigue, foot discomfort, crushing of toes of the foot 44, rubbing, blistering, bruising, callousing or the like. Such fore-aft foot-shoe mislocation can be caused by a shoe 48 being sized too large for or relative to the length of the foot 44, the length of the shoe 48 being too large relative to the length of the foot 44 even though the shoe 48 is technically of the correct shoe size, stretching of the shoe 48 that can occur over time during use of the shoe 48, and/or looseness of fit that can arise from wear of the shoe 48 during use.

While a footwear-snugging fitment 40 constructed in accordance with the present invention can be configured as an elongate, generally rectangular, flexible, cushioned shoe-snugging pad 42 having rounded corners (not shown), a shoe-snugging fitment 40 of the present invention preferably is configured with an elongate, oblong, flexible, padded shoe-snugging pad 42 having a generally oblong, preferably generally rhomboid pad body 62 with a width along its widest part sufficient to overlie at least a quarter, preferably at least one-third, more preferably at least one-half, of the width of the midfoot 60, with such midfoot width measured in a fore-aft direction and/or along a lengthwise direction of the foot 44. In order to be configured to cover or overlie that much of the width of the midfoot 60, a fitment 40 with such a cushioning compressible and flexible foot and shoe locating pad 42 of the present invention is constructed to have a relatively wide pad width of at least two and one-half inches, preferably at least two and three-quarter inches, and more preferably about three inches ±½ inch. The midfoot 60 extends transversely the width of the foot along the part of the foot 44 containing the navicular, cuneiform, talus and cuboid bones of the tarsal bones of the foot and is formed by or of these bones. Such a relatively wide pad width crucially produces a foot-snugging pad 42 of the invention having oppositely outwardly facing foot and shoe spacing and locating surfaces 64 of the pad 42 with enough surface area to space or forwardly displace a substantial part of the top front portion 56 and/or vamp 58 of the shoe 48 in a forward direction relative to the foot 44 received in the shoe 48 thereby snugging up a rear portion 74 of the shoe 48, such as preferably the heel or counter 76 of the shoe 48, against a heel 78 of the foot 44. Such a shoe-snugging pad 42 preferably also has a minimum cross-sectional thickness 50 of at least two millimeters, preferably at least three and one-half millimeters, more preferably at least five millimeters when compressed to its minimum thickness at or adjacent a center of the pad 42 crucially configuring the pad 42 with a sufficient enough thickness to space the front portion or vamp of the shoe far enough forwardly away from the front portion or midfoot of the foot to snug up the shoe on the foot preventing relative fore-aft movement therebetween and compensating for fore-aft foot-shoe mislocation (or even remedying fore-aft mislocation).

It is crucial that the fitment 40 of the present invention be constructed with such an elongate oblong shape having such a minimum thickness inboard of the edging or border 70 and/or in the center of the pad 42 when the pad 42 is maximally compressed, and configured for transverse placement as described and shown in FIG. 2 over and/or along the midfoot 60 of the foot 44 spacing at least top front portion 56 of the shoe 48 forwardly relative to the midfoot 60 away therefrom thereby substantially simultaneously urging the heel or counter 76 of the shoe 48 against the heel 78 of the foot 44 in the shoe 48, This snugging of a rear portion 74 of the shoe 48 against the heel 78 of the foot 44 in the shoe 48 advantageously prevents heel-gapping or up and down movement of the heel 78 of the foot 44 relative to the heel or counter 76 of the shoe 48 from occurring. In such a manner, such a shoe-snugging pad 42 of the present invention is thereby configured to be placed and oriented as shown in FIG. 2 and described herein thereby functioning as a foot locator 65 that helps more accurately locate the foot within the shoe.

The fitment 40, including the pad 42, more properly and/or more accurately helps locate the foot 44 within the shoe 48 by the thickness 50 of the pad 42 helping to accommodate or take up undesired or excessive space between the shoe 48 and foot 44 that could have caused mislocation therebetween the pad 42 of the fitment helping to snug up a top front portion of the shoe 48 with a top front portion, e.g., midfoot 60, of the foot 44. Such a fitment 40 crucially and advantageously not only spaces a top front portion or part of the vamp 103 of the shoe 48 from an adjacent top front portion, preferably midfoot 60, of the foot 44 helping to snug up the front portion of the shoe 48 with the front portion of the foot 44, but in doing so the fitment 40 advantageously can and preferably does help ensure there is a gap or space between the toes 107 of the foot 44 and a forward part, e.g., of the shoe 48, such as the toebox, or other portion of the upper 102 of the shoe 48 surrounding or enclosing the toes 107 of the foot 44 thereby advantageously preventing toe-pressure, rubbing and/or crushing of the toes 107 within the shoe 48 from occurring.

With continued reference to FIGS. 1-4, the fitment 40 and its pad 42 preferably are elongate and have an oblong shape that preferably is generally rhomboid with curved or smoothed rounded top and bottom corners 75, 77 and curved or smoothed rounded side or end corners 85, 87 helping to produce a shoe-snugging and foot-locating pad 42 of the invention that stays in place when positioned between the midfoot 60 of foot 44 of a person wearing the shoe 48 and an adjacent top front part 56 of the shoe 48. Such a fitment 40 and pad 42 preferably have generally straight or slightly convexly curved, e.g., outwardly bowed, but inclined elongate edging or border segments 71, 73, 81, 83 extending respectively between the corners 75, 77, 85, 87 of the pad 42. As also illustrated in FIG. 1, upper and lower corners 75, 77 of the fitment 40 and pad 42 are defined by respective pairs of corresponding edge or border segments 71 & 73 and 81 & 83, each pair of which forms an obtuse included angle. As is also depicted by FIG. 1, the opposite end corners 85, 87 of the pad 42 are defined by respective pairs of corresponding edge or border segments 71 & 81 and 73 & 83, each pair of which forms an acute included angle.

With continued reference to FIGS. 3 & 4, the oblong shoe and foot mislocation correcting fitment 40 is transversely oriented relative to the foot 44 carrying the fitment 40 and is configured with a length long enough so that part of the pad 42 extends along a portion of at least one side 80 of the foot 44, preferably along part of at least one side 80 of the midfoot 60, far enough to space an adjacent portion of a side 104, 106 of the shoe 48 from the corresponding adjacent side 80, 82 of the foot 44. In one preferred embodiment, the fitment 40 and pad 42 of the fitment 40 is configured with a length long enough that the pad 42 extends transversely along the front top surface of the midfoot 60 and in either, both or opposite directions along at least a portion of both sides 80, 82 of the foot 44. In one such preferred embodiment, the pad 42 has a length sufficient to configure the pad 42 to be transversely oriented against a top front surface of the midfoot 60 with oppositely outwardly extending end segments 84, 86 of the pad 42 preferably configured in the form of side spacer wings or flaps 88, 90, having corresponding rounded ends 92, 94 which respectively extend along opposite sides 80, 82 of the midfoot 60.

When centered over and placed on or against the midfoot 60, the fitment 40 and pad 42 are configured with a wider central fore-aft foot spacing or fore-aft shoe-snugging base 55 from which narrower side foot spacing or side shoe-snugging rounded spacer wings 88, 90 oppositely outwardly extend, the fitment 40 and pad 42 are configured not only to provide fore-aft foot location compensation relative to the shoe 48 and fore-aft shoe snugging, but also to provide side-to-side or medial-lateral foot location and side-to-side or medial-lateral shoe snugging. In use and operation, when the fitment 40 and pad 42 are placed on the midfoot 60 of the foot 44 with the fitment 40 and pad 42 oriented generally perpendicularly relative to the lengthwise extent of foot 44, the flexible, padded, cushioning, resiliently compressible central base 55 of the pad 42 overlies a top front portion of the midfoot 60, e.g., center of the midfoot 60 providing fore-aft mislocation compensation and/or correction, one of the flexible, padded, cushioning, resiliently compressible wings 88 extends about and downwardly along part of one side of the foot 44, preferably along at least a portion of one side of the midfoot 60, helping provide side mislocation compensation and/or correction, such as when the foot 44 is narrower than the shoe 48, and the other one of the flexible, padded, cushioning, resiliently compressible wings 90 extends about and downwardly along part of the opposite side of the foot 44, preferably along at least a portion of the other side of the midfoot 60, also helping provide side mislocation compensation and/or correction. When the pad 42 is placed on the midfoot 60 with the pad 42 oriented generally perpendicularly relative to the foot 44, the flexible, padded, cushioning, resiliently compressible central base 55 of the fitment 40 and pad 42 overlies a top front portion of the midfoot 60, e.g., center of the midfoot 60 providing fore-aft shoe snugging, one of the flexible, padded, cushioning, resiliently compressible wings 88 extends about and downwardly along part of one side of the foot 44, preferably along at least a portion of one side of the midfoot 60, helping provide side shoe snugging, such as when the foot 44 is narrower than the shoe 48, and the other one of the flexible, padded, cushioning, resiliently compressible wings 90 extends about and downwardly along part of the opposite side of the foot 44, preferably along at least a portion of the other side of the midfoot 60, also helping provide shoe-snugging in a transverse or side-to-side direction. When the fitment 40 and pad 42 are placed on the midfoot 60 with the fitment 40 and pad 42 oriented generally perpendicularly relative to the lengthwise fore-aft extent of the foot 44, the flexible, padded, cushioning, resiliently compressible central base 55 of the pad 42 of the fitment 40 overlies a top front portion of the midfoot 60, e.g., center of the midfoot 60 helping more properly fore-aft locate the foot in the shoe and prevent relative fore-aft or front-back relative movement therebetween, one of the flexible, padded, cushioning, resiliently compressible wings 88 extends about and downwardly along part of one side of the foot 44, preferably along at least a portion of one side of the midfoot 60, helping more properly side-to-side locate the foot 44 in the shoe 48 and prevent relative sideway relative movement therebetween, such as when the foot 44 is narrower than the shoe 48, and the other one of the flexible, padded, cushioning, resiliently compressible wings 90 extends about and downwardly along part of the opposite side of the foot 44, preferably along at least a portion of the other side of the midfoot 60, also helping more properly side-to-side locate the foot in the shoe and prevent relative sideway relative movement therebetween.

FIG. 5 depict a flexible padded footwear-snugging fitment 40 of the present invention that preferably is oblong and elongate having a length greater than an internal width of a foot-receiving opening 100 in the shoe 48 in which the fitment 40 also is received, with the fitment 40 disposed between a tongue 95 of the vamp 103 of the shoe 48 and part of the foot 44 when the foot 44 is inserted through the opening 100 into the shoe 48. In the preferred embodiment depicted in FIG. 4, the fitment 40 is an oblong and elongate flexible, resilient, compressible, deformable, cushioned, shock and vibration absorbing pad 42 having a length greater than the width between the opposite sides 104, 106 of the sidewall 108 of the shoe 48 that defines the foot-receiving opening 100 of the shoe 48. The fitment 40, preferably pad 42, is shown in FIG. 5 inserted transversely into the foot-receiving opening 100 such that the fitment 40, preferably pad 42, is oriented with its lengthwise direction generally perpendicular to the lengthwise or longitudinal, e.g., proximal-distal, direction of the shoe 48. The fitment 40, preferably includes pad 42, and has a pair of side foot mislocation compensating or correcting wings 88, 90 which each extend outwardly from a central base 55 of the fitment 40 and pad 42 alongside a corresponding adjacent one of the sides 104, 106 of the foot-opening defining sidewall 108 of the shoe 48. When a foot 44 is inserted into the shoe 48 through opening 100, each wing 88, 90 of the fitment is disposed between a respective one of the sides 104, 106 of foot-opening sidewall 108 and a corresponding adjacent one of the sides 80, 82 of the foot 44 (foot not shown in FIG. 5). While the pad 42 of the fitment 40 is shown in FIG. 5 as being disposed between the foot 44 and shoe 48, such as where no hosiery 96, e.g., sock 98, is worn on the foot 44, the fitment 40, including its pad 42, is configured for being positively, securely and preferably substantially immovably retained directly against part of the foot 44 by hosiery 96, such as by putting a sock 98 over the fitment 40 and foot 44.

When so positioned, each wing 88, 90 is configured as a spacer disposed between an adjacent one of the sides 104, 106 of the shoe sidewall 108 and an adjacent one of the sides 80, 82 of the foot 44, preferably adjacent one of the sides of part of the midfoot 60. Each wing 88, 90 spaces the adjacent corresponding side 104, 106 of the shoe sidewall 108 away from the respective adjacent portion of the side 80, 82 of the foot 44, preferably midfoot 60, thereby side snugging the shoe 48 around the foot 44. Being configured with such side-spacer wings 88, 90 that provide such side-snugging of the sides of the shoe 48 around the foot 44 help correct improper loose fit between the shoe and foot caused by the foot being too narrow for the shoe. Such a fitment 40, preferably along with its pad 42, is configured with such side-mislocation reducing spacer wings 88, 90 each of which also advantageously helps prevent side-to-side relative movement from occurring between the foot 44 and shoe 48.

Figure 6:
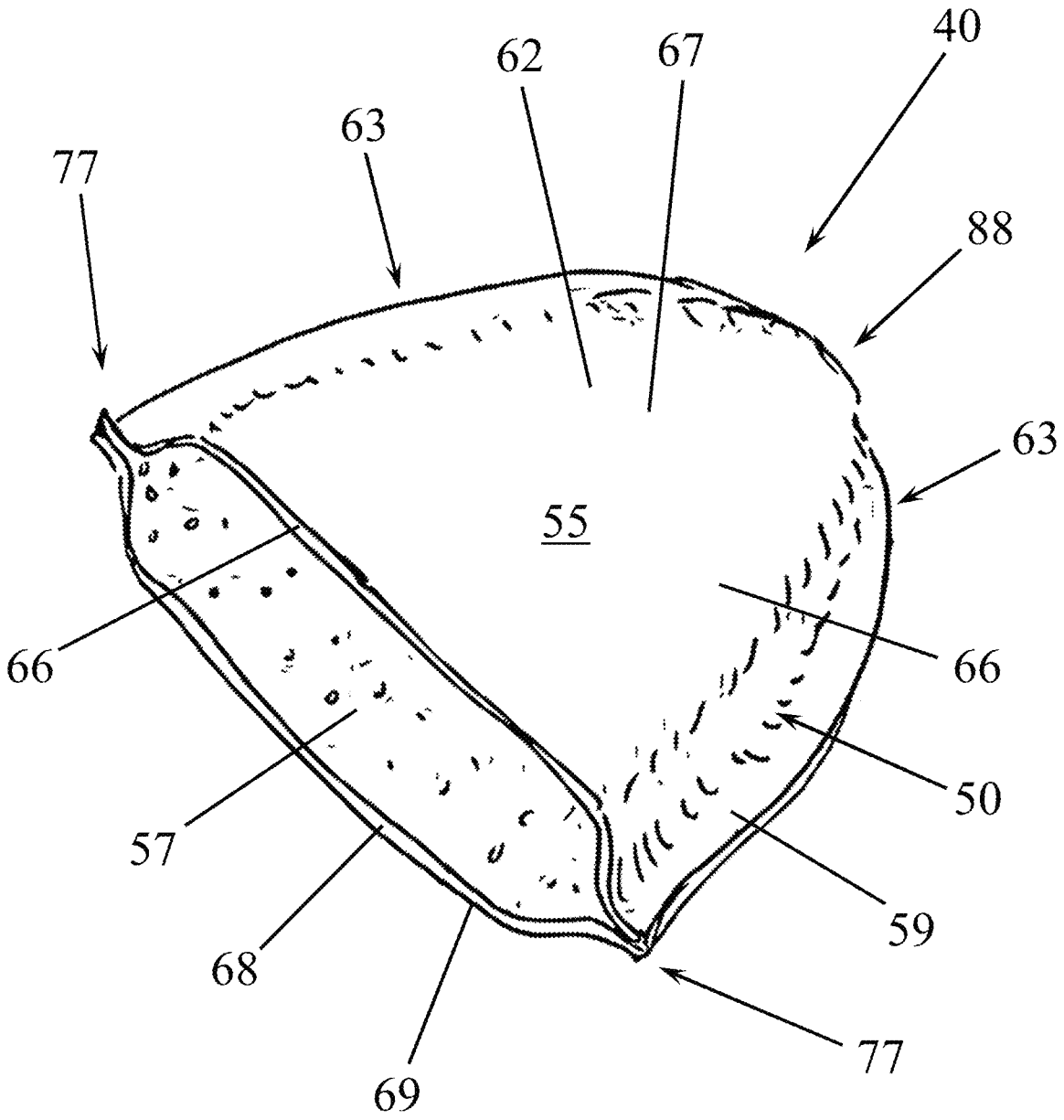
FIG. 6 is a perspective cross-sectional view taken along line 6-6 of FIG. 1 showing a construction method employing foam material adhered to one or more outer fabric layers.

Referring now to FIG. 6, a fitment 40 having the same dimensions and purpose as those described above may be constructed of a foam material 57 such as a urethane foam, which can be an open cell foam, but which preferably is a closed cell foam having the dimensions described above. An upper and lower fabric layer 66 and 68 may be adhesively attached to the upper and lower surfaces of the foam layer 57 and then subsequently cut and heat sealed to form edge seams 59 with the desired rhomboidal periphery 63. The outer fabric layers 66 and 68 may have different surface properties to promote high or low friction, for example to provide sliding with respect to the outer sock on the upper fabric layer 66 while limiting sliding against the skin and to provide a comfortable skin contacting surface on the lower fabric layer 68. In this way the desirable properties of different fabrics and foam may be combined and simplified construction realized. In some embodiments the bottom layer 68 may be a stretch doeskin material or the like while the top layer 66 may be a printed spandex material or the like. The foam material may be a 9900 foam, for example.

Figure 7:
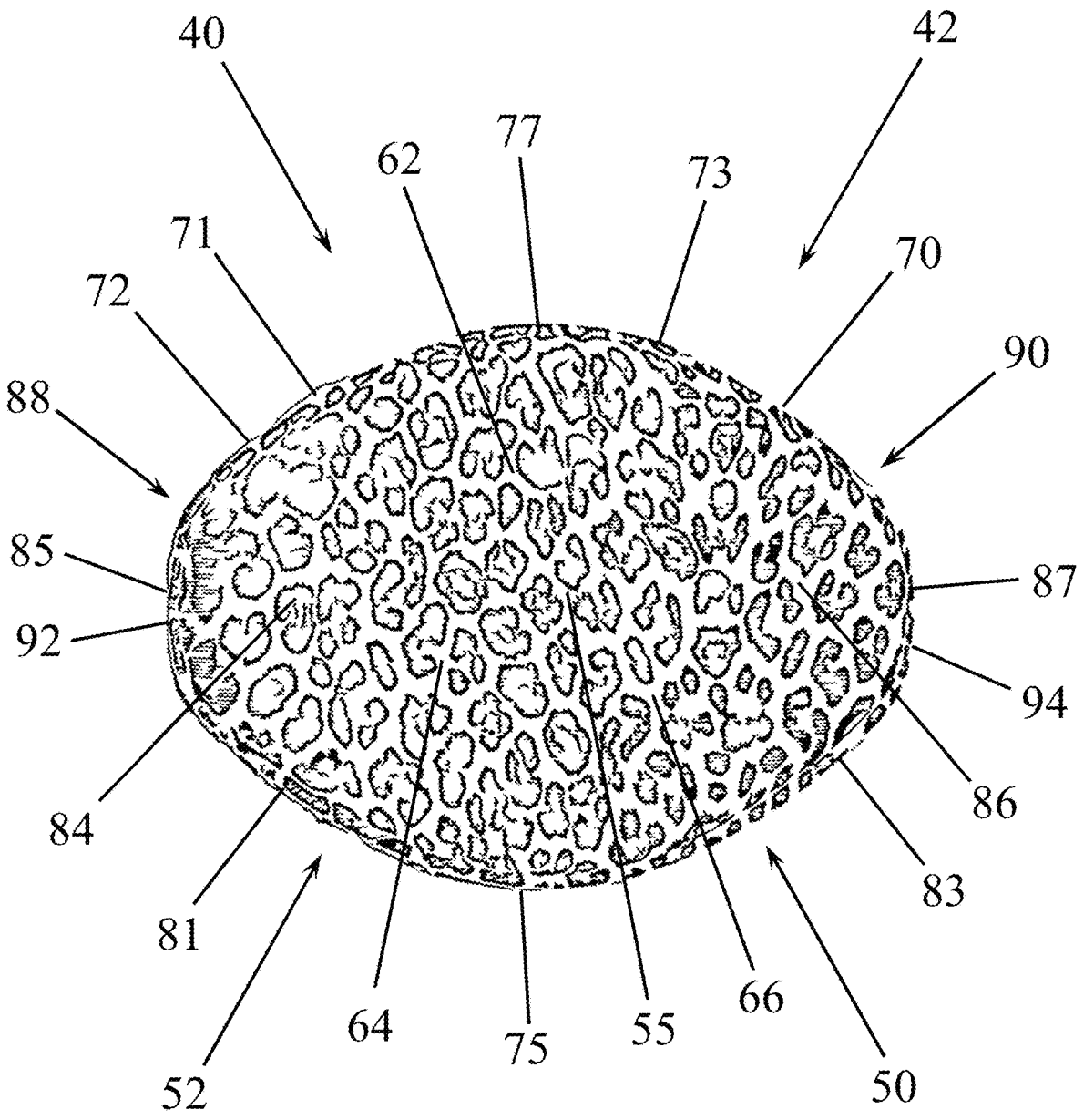
FIG. 7 is a top plan view of a side of the preferred fitment embodiment of FIG. 6 having a low or lower friction outer surface configured to allow cloth, fabric, leather or another type of material in contact therewith to slide relative thereto preventing relative movement therebetween from moving the fitment relative to the skin of the foot of the person using the fitment.

Referring now to FIG. 7, it will be appreciated that the outer fabric layers may be freely decorated to provide a pleasing appearance to this device. As depicted a leopard skin pattern may be applied to the surface 64, although other patterns are also contemplated including for example a camouflage pattern. The patterning may be different on the upper and lower surfaces of the fitment 40 with the more decorated surface providing an indication to the consumer that this surface is to face outward when different fabrics are used.

FIGS. 8-12 illustrate an adjustable shoe-snugging fitment assembly 120 of the present invention that includes an add-on shoe fitment thickness increasing fitment adjuster pad 122 that is removably carried by a fitment adjuster pad carrier 124 of such an adjustable shoe-snugging fitment assembly 120 of the present invention that is composed of the add-on thickness increasing fitment adjuster pad 122 and the fitment adjuster pad carrier 124. The thickness-increasing fitment adjuster pad 122 preferably has a thickness **50*b* of at least two millimeters, preferably at least three millimeters, and more preferably five millimeters when compressed where the fitment adjuster pad 122 is of padded or cushioning compressible construction. Such a thickness-increasing fitment adjuster pad 122 is of substantially the same size but smaller than the fitment adjuster pad carrier 124 of the shoe-snugging fitment assembly 120. When stacked onto the fitment adjuster pad carrier 124, the thickness-increasing fitment adjuster pad 122 has a thickness 50***b* that increases the thickness 50*a* of the fitment adjuster pad carrier 124 by at least two millimeters, preferably at least three millimeters, and more preferably at least five millimeters. When it is desired or required to increase the overall mislocation compensating thickness 50*a* of fitment 40, preferably pad 42, thickness-increasing fitment adjuster pad 122 is added, preferably stacked onto fitment 40, preferably pad 42, which then becomes the fitment adjuster pad carrier 124 of fitment assembly 120 adding its thickness 50*b* to that of the thickness 50*a* of the fitment adjuster pad carrier 124. To enable the thickness increasing fitment adjuster pad 122 to be selectively added to form fitment assembly 120 only when needed, the fitment adjuster pad carrier 124, includes a receptacle 126 in the form of a pocket 128 formed on one of the outer surfaces or layers of pad 42, e.g. fitment adjuster pad carrier 124. Pocket 128 is formed by an outer pocket-forming layer 66' that only partially overlaps a complete and uninterrupted underlying outer layer 66, with the partial pocket-forming outer layer 66' having a hem, stitching, border or edging 130 defining an outer edge 132 and mouth 134 of the add-on pad receiving pocket 128.

Thickness-increasing add-on fitment adjuster pad 122 preferably is of substantially similar construction to fitment 40, e.g., fitment adjuster pad carrier 124, with the thickness-increasing fitment adjuster pad 122 being of flexible, resilient, compressible, and padded or cushioned construction having a pair of outer fabric or cloth layers sandwiching at least one pad-thickness providing inner layer within the fitment adjuster pad 122. Thickness-increasing fitment adjuster pad 122 is generally oval as shown in FIG. 9 with a border or edging extending about its periphery joining the layers together by stitching. Thickness-increasing fitment adjuster pad 122 preferably has a width no greater than that of the width of fitment 40, e.g., fitment adjuster pad carrier 124, which preferably is at least two-thirds the width of fitment 40, e.g., fitment adjuster pad carrier 124. Thickness-increasing fitment adjuster pad 122 preferably has a length no greater than that of the length of fitment 40, e.g., fitment adjuster pad carrier 124, which preferably is at least two-thirds the length of fitment 40, e.g., fitment adjuster pad carrier 124 such that thickness-increasing fitment adjuster pad 122 has end sections 136, 138 that overlie or overlap corresponding side-mislocation compensating flaps or wings 88, 90. The end sections 136, 138 of the thickness-increasing fitment adjuster pad 122 each have a thickness substantially same as the minimum compressed thickness of pad 122 such that each one of the end sections 136, 138 works in concert with the wing 88, 90 it overlies or overlaps to help provide side-mislocation compensation and side-to-side snugging.

FIGS. 13-17 show alternative designs, for example, constructed according to the techniques discussed above with respect to FIG. 6. The designs of FIG. 13 and FIG. 17 provide two sections 140*a* and 140*b* hingeably connected by a hinge line 141 where the foam layer 57 has been compressed or removed to provide a thickness substantially equal to the fabric layers 66, 68 providing a hinge action. FIG. 14 depicts a cardioid shape where the upper edge as shown in the figure provides a concavity for improved comfort against the user's ankle. A similar effect is obtained by the chevron shape of FIG. 15. FIG. 16 provides an hourglass shape with wings 144 that may extend around the foot toward the user's ankles for improved support and centering at the top of the hourglass shape and corresponding wings 146 at the bottom of the hourglass shape that may center the fitment 40 on the top of the user's foot. The waist of the hourglass allows improved flexure to conform with the bending between the ankle and foot.

It is also to be understood that, although the foregoing description and drawings describe and illustrate in detail one or more preferred embodiments of the invention, to those skilled in the art to which the invention relates, the aforementioned will suggest many modifications and constructions as well as widely differing embodiments and applications without thereby departing from the spirit and scope of the invention, including as defined in or by any numbered claims appended hereto.

It is claimed:

1. A flexible and compressible footwear fitment for improving comfort of a foot comprised of skin, the foot wearing a hosiery and an article of footwear having a vamp or an upper, the hosiery disposed between the foot and the article of footwear, and the footwear fitment arranged between the hosiery and a top portion of the foot, the footwear fitment is an elongate, flexible, and resiliently compressible pad that is comprised of (a) a single inner layer of a flexible and resiliently compressible uniformly formed closed cell foam having a pair of oppositely facing surfaces, (b) a first outer layer directly and adhesively secured to one of the pair of oppositely facing surfaces of the closed cell foam inner layer, the first outer layer comprised of a frictionally engaging first outer surface configured for frictional engagement with the skin of the foot to prevent sliding movement of the pad relative to the foot when the frictionally engaging first outer surface is disposed in contact with the skin of the foot, the first outer layer composed of a doeskin, and (c) a second outer layer directly and adhesively secured to the other one of the pair of oppositely facing surfaces of the closed cell foam inner layer, the second outer layer comprised of a second outer surface facing outwardly in a direction opposite the first outer surface, the second outer surface adapted for sliding contact with the hosiery worn on the foot, the second outer layer composed of a spandex configured for allowing sliding movement of the pad relative to the hosiery when disposed in contact with the hosiery; and wherein the pad is arranged between the top portion of the foot and a portion of the hosiery worn on the foot that overlies the top portion of the foot and underlies a part of the vamp or the upper of the article of footwear worn on the foot with the doeskin first outer layer disposed in contact with the skin of the foot and the spandex second outer layer disposed in contact with the hosiery when the pad is disposed between the foot and the hosiery and the pad underlies the vamp or the upper of the article of footwear.

2. The footwear fitment of claim 1, wherein the pad is oblong.

3. The footwear fitment of claim 1, wherein the pad is generally rhomboid-shaped.

4. The footwear fitment of claim 1, wherein the pad is comprised of a pair of ends, each one of the pair of ends having a width, and an intermediate portion disposed between the pair of ends. the intermediate portion having a width that is wider than the width of each one of the pair of ends.

5. The footwear fitment of claim 1, wherein the pad comprises an edge seam extending about a periphery of the foam layer, the edge seam comprised of a portion of the first outer layer sealed to a portion of the second outer layer.

6. The footwear fitment of claim 1, wherein the pad is flexible with the outer layers generally planar and parallel to one another when the pad is not disposed between the top portion of the foot and the portion of the hosiery worn on the foot, and when the pad is disposed between the top portion of the foot and the portion of the hosiery worn on the foot that overlies the top portion of the foot and underlies part of the vamp or the upper of the article of footwear worn on the foot, the flexibility and compressibility of the pad adapts the pad to conform to both (a) a three-dimensional contour of the top of the foot, and (b) a three-dimensional contour of the upper or vamp of the article of footwear worn on the foot that overlies (i) the portion of the hosiery worn on the foot that overlies the pad, and (ii) the pad.

7. The footwear fitment of claim 1, wherein the pad has an uncompressed thickness of at least nine millimeters.

8. The footwear fitment of claim 1, wherein the closed cell foam of the resiliently compressible single inner closed cell foam layer is a urethane foam.

9. The footwear fitment of claim 1, wherein the pad has a hinge formed therein that divides the pad into a plurality of pad sections bendable relative to one another about the hinge.

10. The footwear fitment of claim 9, wherein the hinge extends transversely relative to a lengthwise extent of the pad.

11. The footwear fitment of claim 9, wherein the hinge is formed by a hinge line where the resiliently compressible single inner closed cell foam layer has been compressed or interrupted.

12. The footwear fitment of claim 11, wherein the hinge line is formed where the resiliently compressible single inner closed cell foam layer has been interrupted, the hinge lines is formed by the resiliently compressible single inner closed cell foam layer being removed therealong.

13. The footwear fitment of claim 9, wherein the hinge is formed by a hinge line where the resiliently compressible single inner closed cell foam layer is compressed or removed to provide a thickness of the pad along the hinge line that is substantially equal to the first and second outer layers of the pad.

14. The footwear fitment of claim 1, wherein the pad has a central base and a pair of wings extending oppositely outwardly in opposite directions from the central base, the central base having a width wider than a width of the wings.

15. The footwear fitment of claim 14, wherein the wings of the pad provide footwear mislocation compensation of the foot in the article of footwear worn on the foot.

16. The footwear fitment of claim 14, wherein the pad has a hinge dividing the pad into a plurality of portions of the pad which are bendable relative to one another about the hinge, the hinge extending transversely relative to a lengthwise extent of the pad.

17. The footwear fitment of claim 16, wherein the hinge is comprised of an elongate hinge line formed in one of (a) the central base and (b) one of the wings.

18. The footwear fitment of claim 1, wherein the pad has a pair of sections which extend outwardly in opposite directions from a middle portion that is wider than each one of the sections.

19. The footwear fitment of claim 18, wherein the pad has a hinge dividing the pad into a plurality of portions of the pad which are bendable about the hinge relative to one another, the hinge extending transversely relative to a lengthwise extent of the pad.

20. The footwear fitment of claim 19, wherein the hinge is comprised of an elongate hinge line formed in one of (a) the middle portion of the pad and (b) one of the sections of the pad extending outwardly from the middle portion of the pad.

21. The footwear fitment of claim 20, wherein the pad is generally rhomboid-shaped.

22. The footwear fitment of claim 19, wherein the hinge is comprised of an elongate hinge line formed in the pad between the middle portion of the pad and one of the sections of the pad extending outwardly from the middle portion of the pad.

23. The footwear fitment of claim 22, wherein the pad is generally rhomboid-shaped.

24. The footwear fitment of claim 1, wherein the pad has one of a chevron shape, a cardioid shape, and an hourglass shape.

25. A flexible and compressible footwear fitment for improving comfort of a foot comprised of skin, the foot wearing a hosiery and an article of footwear having a vamp or an upper, the hosiery disposed between the foot and the article of footwear, and the footwear fitment arranged between the hosiery and a top portion of the foot, the footwear fitment consisting of an elongate, flexible, and resiliently compressible pad that is comprised of (a) a single inner layer of a flexible and resiliently compressible uniformly formed closed cell foam having a pair of oppositely facing surfaces, (b) a first flexible outer layer directly and adhesively secured to one of the pair of oppositely facing surfaces of the closed cell foam inner layer, the first outer layer comprised of a frictionally engaging first outer surface the first outer layer composed of one type of fabric configured for frictional engagement with the skin of the foot to prevent sliding movement of the pad relative to the foot when the frictionally engaging first outer surface is disposed in contact with the skin of the foot, and (c) a second flexible outer layer directly and adhesively secured to the other one of the pair of oppositely facing surfaces of the closed cell foam inner layer, the second outer layer having a second outer surface facing outwardly in a direction opposite the first outer surface, the second outer surface adapted for sliding contact with the hosiery worn on the foot, the second outer layer composed of another type of fabric configured for allowing sliding movement of the pad relative to the hosiery when disposed in contact with the hosiery; and wherein the pad is arranged between the top portion of the foot and a portion of the hosiery worn on the foot that overlies the top portion of the foot and underlies a part of the vamp or the upper of the article of footwear worn on the foot with the one type of fabric of the first outer layer disposed in contact with the skin of the foot and the another type of fabric of the second outer layer disposed in contact with the hosiery when the pad is disposed between the foot and the hosiery and the pad underlies the vamp or the upper of the article of footwear.

26. The footwear fitment of claim 25, wherein the pad (a) has a pair of sections which extend outwardly in opposite directions from a middle portion that is wider than each one of the sections, and (b) has a hinge dividing the pad into a plurality of portions of the pad which are bendable about the hinge relative to one another, the hinge extending transversely relative to a lengthwise extent of the pad.

27. The footwear fitment of claim 25, wherein the one type of fabric of the first inner layer is comprised of doeskin and the another type of fabric of the second inner layer is comprised of spandex.

28. The footwear fitment of claim 25, wherein the pad is comprised of a pair of ends, each one of the pair of ends having a width, and an intermediate portion disposed between the pair of ends. the intermediate portion having a width that is wider than the width of each one of the pair of ends.

29. The footwear fitment of claim 25, wherein the pad comprises an edge seam extending about a periphery of the foam layer. the edge seam comprised of a portion of the first outer layer sealed to a portion of the second outer layer.

30. The footwear fitment of claim 25, wherein the pad is generally rhomboid-shaped.

31. The footwear fitment of claim 25, wherein the closed cell foam of the resiliently compressible single inner closed cell foam layer is a urethane foam.

32. The footwear fitment of claim 25, wherein the pad has an uncompressed thickness of at least nine millimeters.

* * * * *